US006885830B2

(12) United States Patent
Hirota et al.

(10) Patent No.: US 6,885,830 B2
(45) Date of Patent: Apr. 26, 2005

(54) IMAGE FORMING APPARATUS CAPABLE OF MOUNTING THERETO ANOTHER DEVELOPING UNIT

(75) Inventors: Makoto Hirota, Ebina (JP); Kunio Yamada, Ebina (JP); Takashi Yamamuro, Ebina (JP); Yasuhiro Kusumoto, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/358,319

(22) Filed: Feb. 5, 2003

(65) Prior Publication Data

US 2004/0037573 A1 Feb. 26, 2004

(30) Foreign Application Priority Data

Aug. 20, 2002 (JP) ..... 2002-239848

(51) Int. Cl.[7] ..... G03G 15/01
(52) U.S. Cl. ..... 399/12; 399/53; 399/54
(58) Field of Search ..... 399/226, 227, 399/223, 53, 54, 12

(56) References Cited

U.S. PATENT DOCUMENTS 4,662,737 A * 5/1987 Ueguri ..... 399/223
4,871,408 A 10/1989 Honma et al.
5,180,650 A 1/1993 Sacripante et al.
5,541,720 A * 7/1996 Haneda ..... 399/119
5,862,430 A * 1/1999 Mitekura et al. ..... 399/13
6,165,667 A 12/2000 Takagi et al.
6,192,211 B1 * 2/2001 Kimura ..... 399/227
6,266,492 B1 * 7/2001 Maehara ..... 399/12
6,301,460 B1 * 10/2001 Elliott ..... 399/227
6,308,018 B1 * 10/2001 Yoshida et al. ..... 399/53
6,327,450 B1 * 12/2001 Ito ..... 399/227
6,336,020 B1 * 1/2002 Ishikawa et al. ..... 399/227
6,738,591 B1 * 5/2004 Hattori et al. ..... 399/119

FOREIGN PATENT DOCUMENTS

EP 1 124 165 A1 8/2001
JP A 2000-131875 5/2000
JP A 2001-194846 7/2001

* cited by examiner

*Primary Examiner*—Susan Lee
(74) *Attorney, Agent, or Firm*—Oliff & Berridge, PLC

(57) ABSTRACT

There is provided an image forming apparatus in which, if the image forming apparatus using only a normal toner is modified to be capable of forming an image formed of a special toner, an appropriate image can be formed in accordance with the characteristics of the special toner.

21 Claims, 16 Drawing Sheets

(a)

(b)

IMAGE FORMING APPARATUS CAPABLE OF MOUNTING THERETO ANOTHER DEVELOPING UNIT

FIELD OF THE INVENTION AND RELATED ART STATEMENT

The present invention relates to an image forming apparatus using an electrophotographic system, such as a copying machine, a printer, a facsimile, or a combination machine of the above-mentioned machines, and more specifically to an image forming apparatus in which a special image can be obtained in addition to a normal toner image.

Conventionally, an image forming apparatus such as a copying machine or a printer that utilizes the electrophotographic system or the electrostatic transfer system is widely known. In such an image forming apparatus, a black-and-white image, a full-color image formed with toners of yellow, cyan, and magenta, and the like are usually formed on a paper and outputted. In addition, unlike the technique for obtaining these (flat) images, there has been proposed a technique for obtaining a three-dimensional image using a special toner (foaming toner). For example, the applicant has already proposed "Image forming toner, preparation method thereof, three-dimensional image forming method and image forming apparatus" and "Image forming apparatus" in JP 2000-131875 A and JP 2001-194846 A, respectively. Further, there has been conventionally proposed a technique for obtaining an image in gold, silver, etc. using a special toner (toner of a metallic color).

However, it is inappropriate that all the image forming apparatuses are previously constructed to be capable of forming an image by using a special toner (foaming toner or toner of a metallic color). This is because a user who does not need an image formed of the special toner is compelled to unnecessary functions and costs. On the other hand, it is inefficient to manufacture completely separately an image forming apparatus using only a normal toner and an image forming apparatus using the special toner as well as the normal toner. Therefore, it is conceivable that an optional developing device using a special toner is mounted to the image forming apparatus using only a normal toner, so that an image forming apparatus to meet the users' needs is efficiently provided.

Note that, as for the special toner, it is required in its nature to specify the order that toners are superposed on the paper. The reason for this is as follows. That is, for example, if a toner layer including a foaming-toner layer is laminated on a paper, by arranging the foaming-toner layer on the lower side than a normal-toner layer (first developer) mainly used for coloring, a colored layer including the first developer can be lifted by the foaming-toner layer from underneath, so that a three-dimensional image can be obtained. Also, it is difficult to inhibit appropriate color reproduction (formation) due to a color mixture among the first developers, so that an objective optimal image can be obtained. If the foaming-toner layer is formed in the upper layer or the intermediate layer of the first developer, particularly color reproducibility deteriorates. Further, in the case of laminating a toner layer including a metallic-toner layer on a paper, when the metallic-toner layer is not mixed with other colors, a gloss with more metallic sensation can be obtained. Accordingly, the color mixture can be avoided as much as possible by forming the metallic-toner layer in the uppermost layer with respect to other toner layers, so that an objective optimal image can be obtained.

OBJECT AND SUMMARY OF THE INVENTION

Therefore, the present invention has been made in view of the above circumstances and provides an image forming apparatus in which, if the image forming apparatus using only a normal toner is modified to be capable of forming an image formed of a special toner, an appropriate image can be formed in accordance with characteristics of the special toner.

According to the present invention, there is provided an image forming apparatus including: an image bearing member; a first developing unit for forming an image consisting of one kind or plural kinds of first developer on the image bearing member; a transfer section for transferring the image formed on the image bearing member onto a recording medium, the image forming apparatus being capable of mounting thereto a second developing unit for forming an image consisting of one kind or plural kinds of second developer different from the first developer on the image bearing member; a developing unit judging section for judging a kind of a developing unit included in the image forming apparatus; and a control unit for controlling stacking of images on the recording medium based on a judgment result of the developing unit judging section.

Here, the second developing unit may be (alternatively) mountable so as to replace an entirety or a part of the first developing unit, or may be (additionally) mountable so as to be added to the first developing unit. Also, the developing unit may be mounted to the image forming apparatus one by one, or the plural developing units may be collectively mounted to the image forming apparatus. Moreover, the developing unit may be mounted to the image forming apparatus solely by itself, or an image forming unit including the image bearing member as well as the developing unit may be mounted to the image forming apparatus.

In addition, the first developer and the second developer can be distinguished from each other in that the first developer does not contain a foaming agent and the second developer contains a foaming agent, the first developer contains a colorant of a nonmetallic color and the second developer contains a colorant of a metallic color, the first developer contains a colorant of a chromatic color and the second developer contains a colorant of an achromatic color, or the first developer contains a specific colorant and the second developer contains a colorant different from the specific colorant.

Examples of the first developer include a developer (of one type) containing a colorant of black, developers of three types containing colorants of yellow, magenta, and cyan, respectively, and developers of four types containing a colorant of black in addition to these developers of three types. In addition, as examples of the second developer, there are a colorless developer (of one type) containing a foaming agent and not containing a colorant, a developer (of one type) containing a foaming agent and a colorant, a developer (of one type) not containing a foaming agent and containing a colorant of a metallic color, and developers of plural types that are arbitrary combinations of the above-mentioned developers. Note that the foaming agent and the colorant may be internally added or externally added to a developer.

Further, under a first control performed by the control unit, the image forming apparatus can be controlled such that, in the case of using the second developing unit mounted thereto, an image consisting of the second developer is formed into a specific-level layer within a stack of images on the recording medium. Here, the specific-level layer may be (1) automatically determined by the image forming apparatus (without an operation by a user), or (2) determined based on an instruction by a user.

In other words, in the case of the former (1), the specific-level layer is automatically determined in accordance with the kind of the second developing unit to be used. For example, if the first developer contains no foaming agent and the second developer contains a foaming agent, the specific-level layer is automatically determined to be a lowermost layer in the stack of the images on the recording medium. In another example, if the first developer contains a colorant of a nonmetallic color and the second developer contains a colorant of a metallic color, the specific-level layer is automatically determined to be an uppermost layer in the stack of the images on the recording medium.

Alternatively, in the case of the latter (2), a user interface section to which an instruction from a user is inputted is provided to the image forming apparatus, and the specific-level layer is determined based on an instruction from the user interface section. Examples of the user interface section include an operation button and an operation panel of the image forming apparatus. In the similar case where the specific-level layer is determined based on an instruction from the user, the instruction from the user may be transmitted to a printer (image forming apparatus) via a computer (including a printer driver) connected thereto.

Examples of a method of controlling the stacking of the images on the recording medium include: a method of controlling the stacking of the images on the recording medium by controlling the order that each developing unit forms an image on the image bearing member by the control unit; and a method of controlling the stacking of the images by controlling the order that the transfer section transfers the images (onto the intermediate transfer member and the recording medium) by the control unit.

Further, under a second control performed by the control unit, the image forming apparatus can be controlled such that, in the case of using the second developing unit mounted thereto, an image consisting of the second developer is formed to be laminated on the recording medium based on an electrophotographic parameter (one or more parameters selected from the group consisting of, for example, a developing bias, a charging bias (an image bearing member surface potential), a transferring bias, a fixing temperature, a fixing rate, and an image processing parameter) which differs from the electrophotographic parameter used in the case where an image consisting of the first developer is formed to be laminated on the recording medium. Here, the electrophotographic process parameter may be automatically determined by the kind of the second developing unit to be used.

Further, in order to judge the kind of the developing unit mounted to the image forming apparatus, the developing unit may have a special shape in accordance with its developer, and may include the developing unit judging section for judging the kind of the mounted developing unit based on the special shape. Also, the developing unit may include a nonvolatile memory for storing developer information that indicates a developer of the developing unit in the nonvolatile memory, and may include the developing unit judging section for judging the kind of the mounted developing unit based on the read developer information. Moreover, if the image forming unit including the image bearing member as well as the developing unit is mounted to the image forming apparatus, the image forming unit may have the special shape in accordance with the developer, or may include the non-volatile memory.

Also, the present invention relates to an image forming apparatus including: an image bearing member; a first developing unit for forming an image consisting of one kind or plural kinds of first developer on the image bearing member; and a transfer section for transferring the image formed on the image bearing member onto a recording medium, the image forming apparatus being capable of mounting thereto a second developing unit for forming an image consisting of one kind or plural kinds of second developer on the image bearing member.

Further, according to the present invention, there is also provided an image forming apparatus which includes an image bearing member, a first developing unit for forming an image consisting of one kind or plural kinds of first developer on the image bearing member, and a transfer section for transferring the image formed on the image bearing member onto a recording medium, and to which a second developing unit for forming an image consisting of one kind or plural kinds of second developer on the image bearing member is mountable, the image forming apparatus including: a user interface section to which an instruction from a user is inputted; and a control unit for controlling the image forming apparatus such that, in the case of using the second developing unit mounted thereto, an image consisting of the second developer is formed into a specific-level layer within a stack of images on the recording medium, the specific-level layer being determined based on the instruction from the user interface section.

In addition, the transfer unit may include only a final transfer section and transfer an image on the image bearing member to a recording medium directly. Alternatively, the transfer unit may be provided with an intermediate transfer member and an intermediate transfer section in addition to the final transfer section, transfer an image on the image bearing member to the intermediate transfer member once by the intermediate transfer section, and further transfer the image on the intermediate transfer member to a recording medium by the final transfer section.

Further, the present invention can be applied to any image forming apparatus of the electrophotographic system. Turning to a relationship between a developing unit and an image bearing member (photosensitive member, latent image bearing member), there are an image forming apparatus in which each developing unit and image bearing member has a one to one relationship and an image forming apparatus in which each developing unit and image bearing member has an N (N is a natural number) to one relationship. As examples of the former image forming apparatus, there are a monochrome image forming apparatus, a full-color image forming apparatus of the tandem system using an intermediate transfer member, from an upstream side to a downstream side of which image forming units corresponding to each color are arranged, and the like. As examples of the latter image forming apparatus, there are image forming apparatus using a developing apparatus of the rotary system, a full-color image forming apparatus in which developing units corresponding to each color are arranged from an upstream side to a downstream side of an image bearing member, and the like.

As described above, according to the present invention, if the image forming apparatus using only a normal toner is modified to be capable of forming an image formed of a special toner, there can be provided an image forming apparatus capable of forming an appropriate image in accordance with the characteristics of the special toner.

BRIEF DESCRIPTION OF THE DRAWINGS

Preferred embodiments of the present invention will be described in detail based on the following drawings, wherein:

FIGS. 3A and 3B are cross-sectional schematic views for explaining a rotary developing apparatus of the color printer or the color copying machine according to Embodiment Mode 1 of the present invention;

FIGS. 5A to 5C are cross-sectional views for explaining projected portions and buttons of a developing device of the rotary developing apparatus of FIGS. 3A and 3B;

FIGS. 8A1 to 8A4, 8B1 to 8B4, and 8C are used for explaining steps and states of stacking toner images on a photosensitive drum, an intermediate transfer belt, and a recording paper;

FIGS. 12A1 to 12A3, 12B1 to 12B3, and 12C are used for explaining steps and states of stacking toner images on a photosensitive drum, an intermediate transfer belt, and a recording paper;

FIGS. 13A1 to 13A5, 13B1 to 13B5, and 13C are used for explaining steps and states of stacking toner images on a photosensitive drum, an intermediate transfer belt, and a recording paper;

DETAILED DESCRIPTION OF THE PREFERRED EMBODIMENTS

Embodiment Modes of the present invention will be hereinafter described with reference to the accompanying drawings properly.

Embodiment Mode 1

Figure 1:
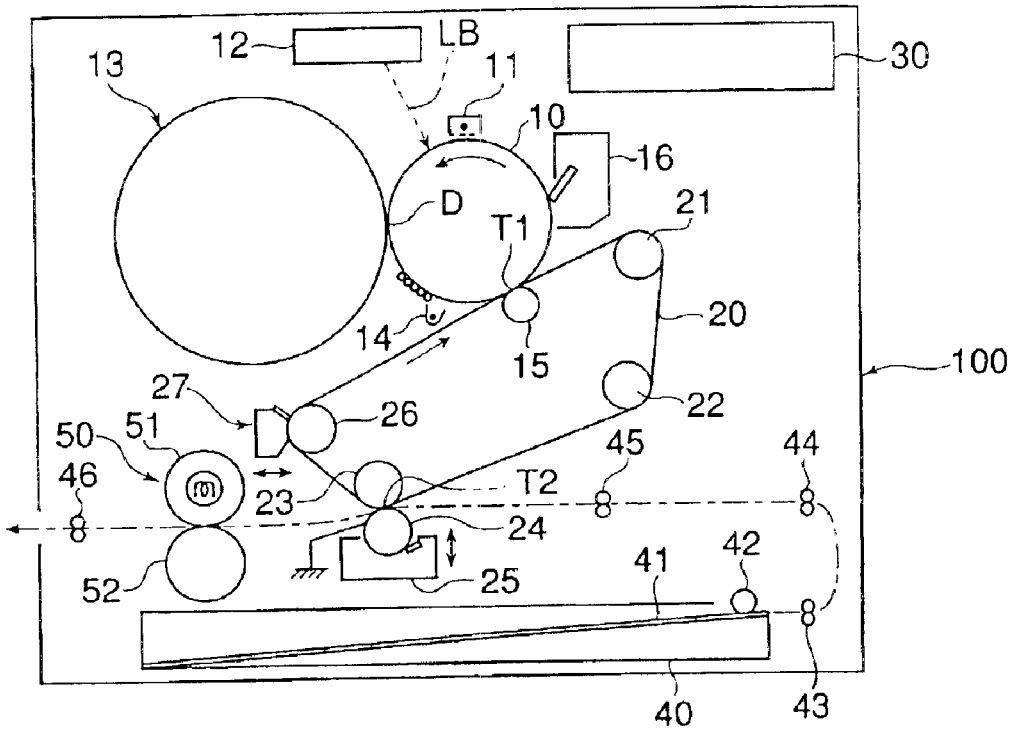
FIG. 1 is a cross-sectional schematic view for explaining an example of a color printer according to Embodiment Modes 1 to 3 of the present invention.

FIG. 1 shows a color printer 100 of the electrophotographic system as an image forming apparatus according to Embodiment Mode 1 of the present invention. In addition, FIG. 2 shows a color copying machine 102 of the electrophotographic system as the image forming apparatus according to Embodiment Mode 1 of the present invention.

Figure 2:
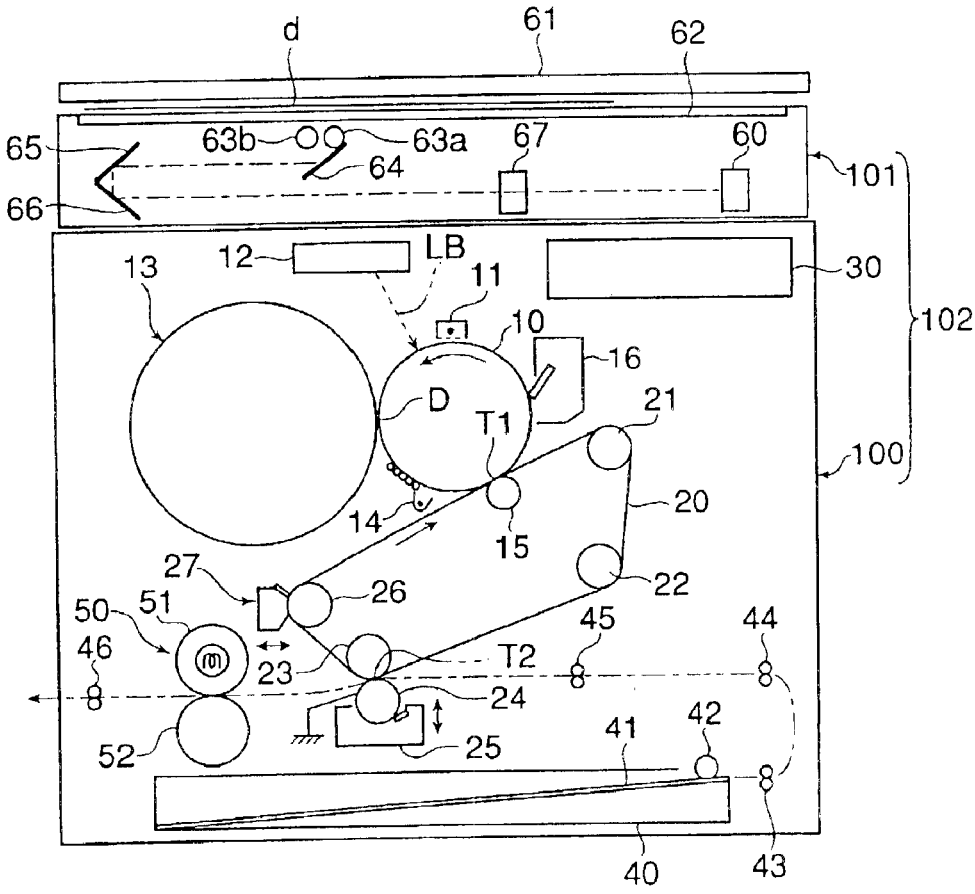
FIG. 2 is a cross-sectional schematic view for explaining an example of a color copying machine according to Embodiment Modes 1 to 3 of the present invention.

In FIGS. 1 and 2, reference numeral 100 denotes a color printer and a main body of a color copying machine. As shown in FIG. 2, an original reader 101 for reading an image of an original d pressed by a platen cover 61 is arranged above this color copying machine main body 100. This original reader 101 is adapted to illuminate the original d placed on a platen glass 62 with light sources 63*a* and 63*b*, scan and expose a reflected light image from the original d on an image reading element 60 including CCD via a reduction optical system including a full-rate mirror 64, half-rate mirrors 65 and 66, and a focusing lens 67, and read a light image reflected by coloring material of the original d with this image reading element 60 at a predetermined dot density (e.g., 16 dots/mm).

The light image reflected by coloring material of the original d read by the original reader 101 is sent to an image processing apparatus 30 as, for example, reflectance data of original for three colors of red (R), green (G), and blue (B) (8 bits each). In this image processing apparatus 30, predetermined image processing such as shading correction, positional deviation correction, brightness/color spatial conversion, gamma correction, frame deletion, or color/movement edition is applied to the reflectance ratio data of the original d.

Then, the image data subjected to the predetermined image processing in the image processing apparatus 30 as described above is sent to a raster output scanner (ROS) 12 as gradation data of original coloring material for four colors of yellow (Y), magenta (M), cyan (c), and black (BK) (8 bits each). In this ROS 12, image exposure by laser beams is performed according to the gradation data of original coloring material.

An image forming section capable of forming plural toner images of different colors is disposed inside the color printer 100 and the copying machine main body 100. This image forming section is constituted mainly of the ROS 12 as an image exposure section, a photosensitive drum 10 as an image bearing member on which an electrostatic latent image is formed, and a developing apparatus 13 of the rotary system as a developing section capable of developing the electrostatic latent image formed on the photosensitive drum 10 to form plural toner images of different colors.

As shown in FIGS. 1 and 2, the ROS 12 modulates a not-shown semiconductor laser according to gradation data of original reproducing coloring material and emits a laser beam LB from this semiconductor laser according to the gradation data. The laser beam LB emitted from this semiconductor laser is deflected and scanned by a not-shown rotary polygon mirror, and scanned and exposed on the photosensitive drum 10 as an image bearing member via a not-shown f·θ lens and reflection mirror.

The photosensitive drum 10 on which the laser beam LB is scanned and exposed by the ROS 12 is adapted to be rotated and driven at a predetermined speed along an arrow direction by a not-shown drive section. The surface of this photosensitive drum 10 is charged to a predetermined polarity (e.g., negative polarity) and potential by a Scorotron 11 for primary charging in advance and, then, an electrostatic latent image is formed as the laser beam LB is scanned and exposed according to the gradation data of original reproducing coloring material. For example, the surface of the photosensitive drum 10 is uniformly charged to −650 V and, then, the laser beam LB is scanned and exposed on an image portion thereof, and an electrostatic latent image with −200 V in the exposed part is formed thereon.

The electrostatic latent image formed on the photosensitive drum 10 is subjected to reversal development, for example, with a toner (charged coloring material) charged in the negative polarity, which is the same polarity as the charged polarity of the photosensitive drum 10, in a development region D by the developing apparatus 13 of the rotary system provided with developing devices (first developing units) 13Y to 13BK corresponding to yellow (Y), magenta (M), cyan (C), and black (BK), and turns into a toner image T of a predetermined color. In this case, for example, a developing bias voltage of −500 V is applied to developing rolls of the developing devices 13Y to 13BK. Note that the toner image formed on the photosensitive drum 10 is subjected to charging of a negative polarity by a pre-transfer charger 14 if necessary, and an amount of charges of the toner image is adjusted.

A toner image (image) of a toner (first developer) of each color formed on the photosensitive drum 10 is multiply transferred onto an intermediate transfer belt 20 serving as an intermediate transfer member, which is arranged below the photosensitive drum 10, at a first nip portion T1 by a primary transfer roll 15 serving as a first transfer section. This intermediate transfer belt 20 is stretched and suspended by a drive roll 21, a driven roll 26, a tension roll 22, and a backup roll 23 serving as an opposed roll forming a part of a secondary transfer section, and supported rotatably along an arrow direction at a moving speed identical with a peripheral speed of the photosensitive drum 10.

Toner images of all or a part of four colors of yellow (Y) magenta (M), cyan (C), and black (BK) formed on the photosensitive drum 10 are sequentially transferred in a stacked state onto the intermediate transfer belt 20 by the primary transfer roll 15 according to a color of an image to be formed. The toner image transferred onto the intermediate transfer belt 20 is transferred onto a recording paper P, which serves as a recording medium to be conveyed to a secondary transfer position T2 at predetermined timing, by a press-contacting force and an electrostatic attracting force acting between the backup roll 23 supporting the intermediate transfer belt 20 and a secondary transfer roll 24 forming a part of the secondary transfer section that is in press-contact with the backup roll 23.

As shown in FIGS. 1 and 2, the recording paper (recording medium) P of a predetermined size supported by a sheet guide 41 is fed from a sheet feeding cassette 40, which serves as a recording medium containing member arranged in the lower part of the color printer 100 and the copying machine main body 100, by the pickup roll 42 and feed and retard rolls 43. The fed recording paper P is conveyed to a secondary transfer position T2 of the intermediate transfer belt 20 at predetermined timing by plural conveyor rolls 44 and registration rolls 45. Then, as described above, toner images of predetermined colors are collectively transferred onto the recording paper P from the intermediate transfer belt 20 by the backup roll 23 and the secondary transfer roll 24 serving as the secondary transfer section.

In addition, after being separated from the intermediate transfer belt 20, the recording paper P, to which the toner images of predetermined colors are transferred from the intermediate transfer belt 20, is conveyed to a fixing apparatus 50. Then, the toner images are fixed on the recording paper P with heat and pressure by a heating roll 51 and a pressure roll 52 of the fixing apparatus 50, and discharged to the outside of the color printer 100 and the copying machine main body 100, whereby the process of forming a color image ends.

Note that, in FIGS. 1 and 2, reference numeral 16 denotes a cleaning device for removing a residual toner, paper powder, and the like from the surface of the photosensitive drum 10 after the transfer process ends; 27, a cleaner for intermediate transfer belt for cleaning the intermediate transfer belt 20; and 25, a cleaner for cleaning the secondary transfer roll 24. In addition, the cleaner for intermediate transfer belt 27 and the cleaner 25 for the secondary transfer roll 24 are constituted so as to come into contact with and separate from the intermediate transfer belt 20 at predetermined timing.

Incidentally, in the color printer 100 and the color copying machine 102 according to Embodiment Mode 1, it is possible to mount a developing device (secondary developing unit) 13E corresponding to a foamable toner E (second developer containing a foaming agent and not containing a colorant) in place of one of the developing devices (first developing units) 13Y to 13BK corresponding to toners (first developers not containing a foaming agent and containing a colorant of a nonmetallic color) of yellow (Y), cyan (C), magenta (M), and black (BK), respectively. Note that, when heated by the fixing apparatus 50, the foamable toner E discussed later is expanded by the heat and can form a three-dimensional image on the recording paper P.

Figure 3:
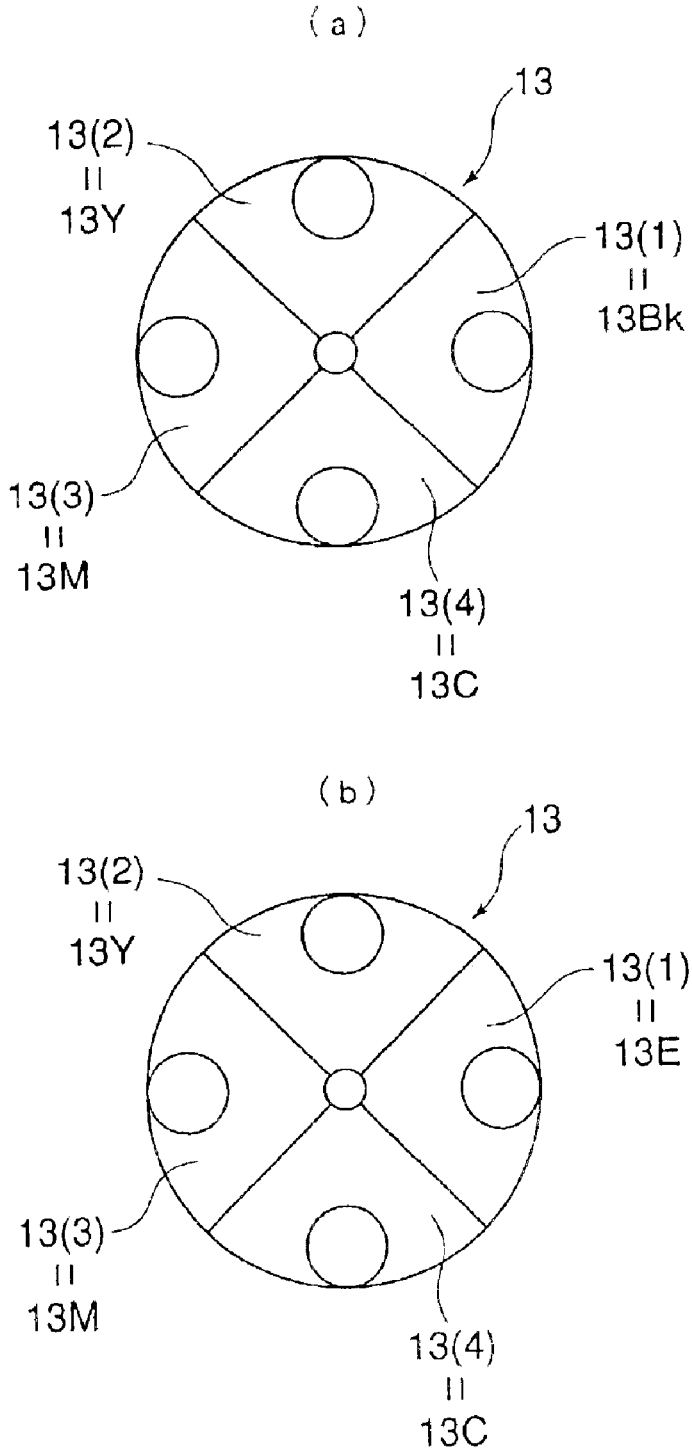
Figure 4:
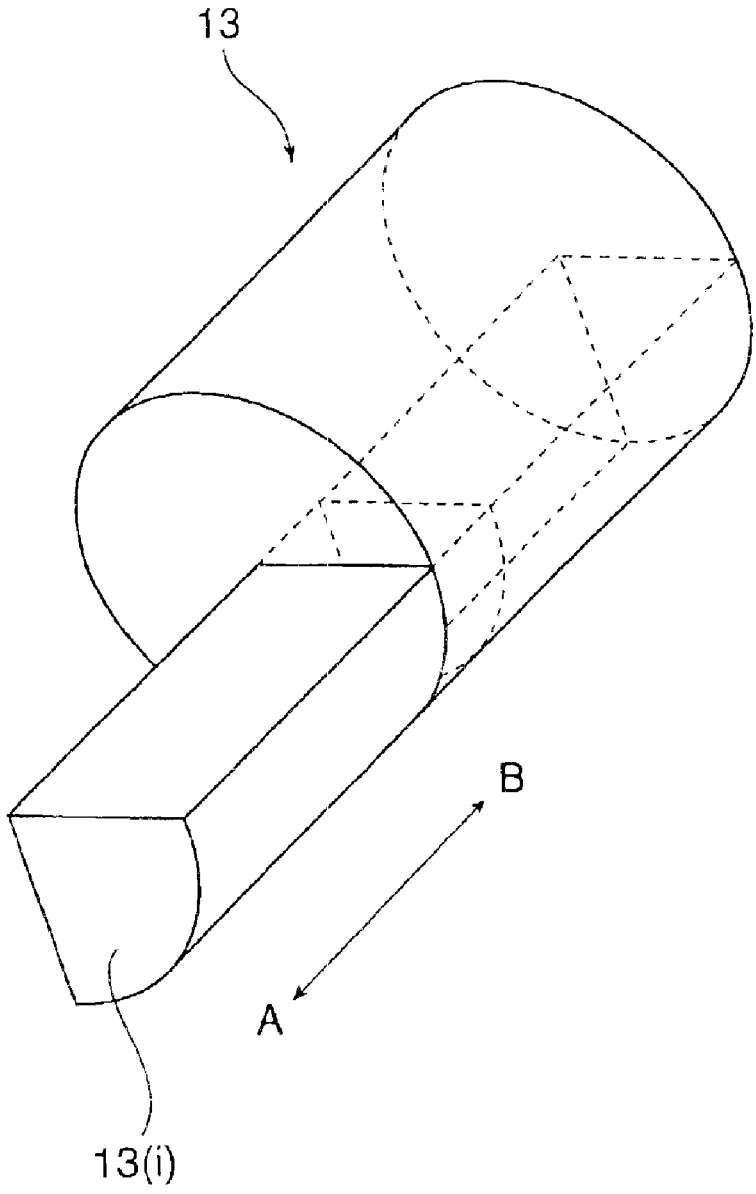
FIG. 4 is a perspective view for explaining how a developing device is removed from the rotary developing apparatus of FIGS. 3A and 3B.

As shown in FIGS. 3A and 3B, the developing apparatus 13 of the rotary system is provided with first to fourth developing devices 13(1) to 13(4) different from each other for each of its four areas divided equally in a fan shape around its rotation axis. In addition, as shown in FIG. 4, each of the developing devices 13(1) to 13(4) slides along a guide rail provided in each of the developing devices 13(1) to 13(4), which is parallel with the rotation axis, and a guide rail support provided in the developing apparatus main body to be opposed to the guide rail by applying a force in a direction B and a direction A in the figure, and is constituted detachably.

In this way, in the color printer 100 and the color copying machine 102 using only the normal toners of yellow (Y), cyan (C), magenta (M), and black (BK), it becomes also possible to form an image with the special foamable toner E simply by replacing developing devices.

Figure 5:
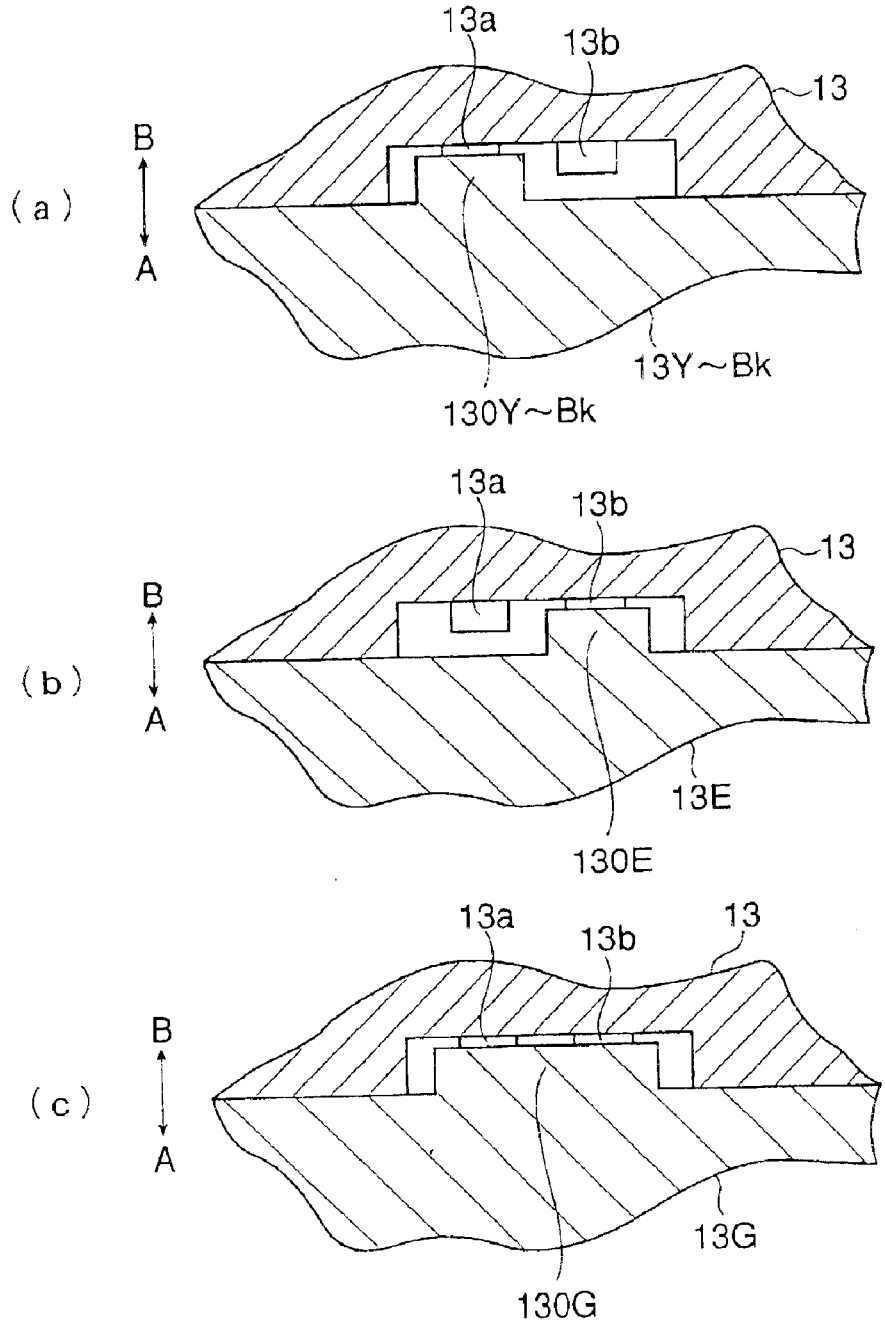

In addition, as shown in FIGS. 5A to 5C, in a developing apparatus main body 13, a first button (developing unit judging section) 13*a* and a second button (developing unit judging section) 13*b* are provided. In each of the developing devices 13(1) to 13(4), a projected portion (special shape) 130 of a shape corresponding to characteristics of a developer contained in the developer is provided. The developing apparatus main body 13 is constituted such that, when each of the developing devices (1) to (4) is mounted on the developing apparatus 13, these first and second buttons 13*a* and 13*b* and the projected portion 130 are opposed to each other.

Here, in each of the developing devices 13Y to 13BK corresponding to the toners of yellow (Y), cyan (C), magenta (M), and black (BK), first projected portions 130Y to 130BK are formed as shown in FIG. 5A. When the developing devices 13Y and 13BK are mounted on the developing apparatus main body 13, only the first button 13*a* is pressed. In addition, in the developing device 13E corresponding to the foamable toner F, a second projected portion 130F as shown in FIG. 5B is formed. When the developing device 13E is mounted on the developing apparatus main body 13, only the second button 13*b* is pressed. Note that, in a developing device 13G corresponding to a gold toner G in Embodiment Mode 2 discussed later, a third projected portion 130G as shown in FIG. 5C is formed. When the developing device 13G is mounted on the developing apparatus 13, both the first button 13*a* and the second button 13*b* are pressed. Note that, although the developing devices of three types (the developing devices Y to BK, the developing device E, and the developing device G) are explained as being distinguished for simplicity, the developing devices Y to BK can be distinguished, respectively, by increasing the number of combinations of buttons and projected portions.

Moreover, when a developing device of the color printer 100 and the color copying machine 102 according to Embodiment Mode 1 is replaced, update of <1> an order of image formation, <2> image processing parameters, and <3> electrophotographic process parameters is automatically controlled according to characteristics of a toner contained in the replaced developing device. In this way, the image forming apparatus according to Embodiment Mode 1 makes it possible not only to form an image with the special foamable toner E by replacing a developing device but also to form an appropriate image according to characteristics of the foamable toner E.

Figure 6:
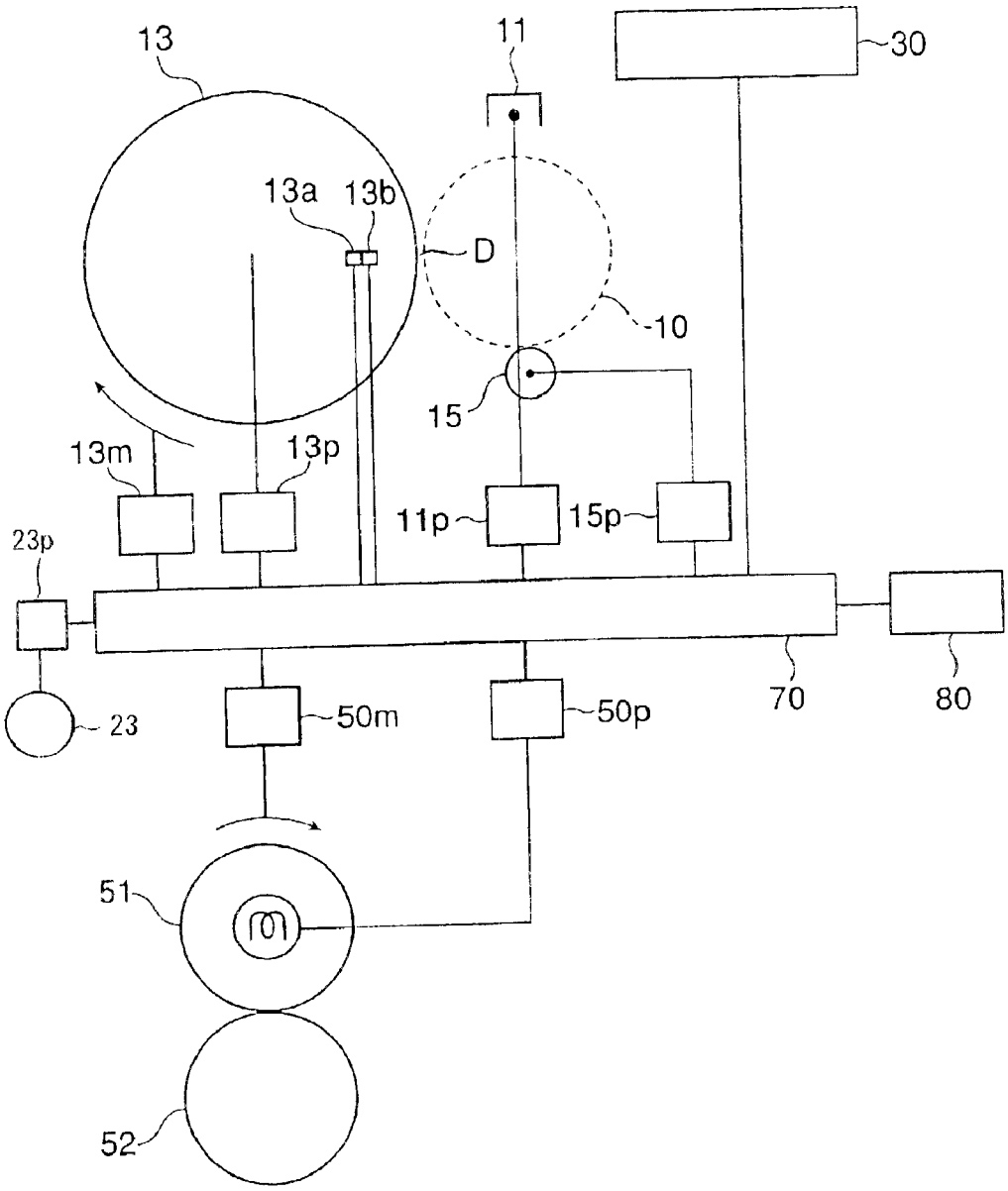
FIG. 6 is a block diagram for explaining a structure of a control system of the color printer or the color copying machine according to Embodiment Modes 1 to 3 of the present invention.

FIG. 6 is a functional block diagram illustrating a structure of this update control system. This control system is constituted with a control unit 70 as a main part. Signals inputted in the control unit 70 are <1> ON/OFF signals from the first button 13*a* and the second button 13*b* and <2> an instruction signal from a user interface device (user interface section) 80 including a touch panel or an operation button of the color printer 100 or a color copying machine 102. Signals outputted to the control unit 70 are <1> a drive command given to a developing motor 13*m* for rotating the developing apparatus 13 of the rotary system, <2> an image processing update command for updating image processing parameters in the image processing apparatus 30, and <3> a process update command for updating electrophotographic process parameters in each functional components of an image forming apparatus.

Moreover, this process update command of <3> includes a charging bias update command given to a charging power supply section lip for applying a charging bias to the Scorotron 11, a developing bias update command given to a developing power supply section 13*p* for applying a developing bias to each of the developing devices 13(1) to 13(4) of the developing apparatus 13, a primary bias update command given to a primary transfer power supply section 15*p* for applying a primary transfer bias to the primary transfer roll 15, a drive command given to a fixing motor 50*m* for rotating the heating roll 51 and the pressure roll 52, and a heating power update command given to a heating power supply section 51*p* for applying an electric power to a halogen lamp (heating source) of the heating roll 51. The control unit 70 can control a charging potential, a developing bias, a primary transfer bias, a secondary transfer bias, a fixing rate, and a fixing temperature on the photosensitive drum 10 according to these process update commands, respectively.

Note that, as a specific structure of the control unit 70, the control unit 70 is provided with a hardware configuration including a central processing unit, a control device, a memory device, an input/output device, a bus connecting these devices each other, and the like, and a software configuration including a control program and the like stored in the memory device in advance. Functions of the control unit 70 are realized by the hardware configuration and the software configuration.

Figure 7:
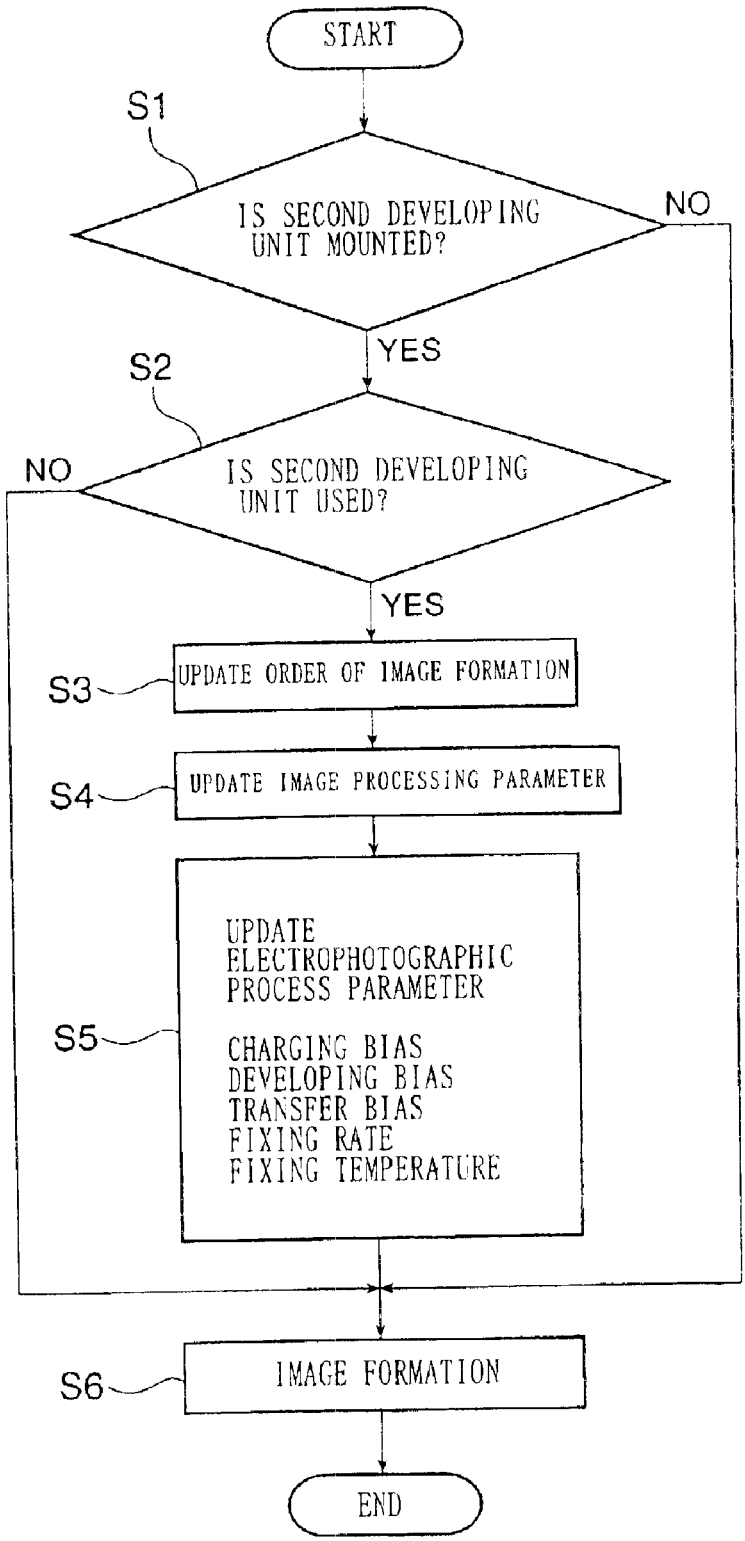
FIG. 7 is a flow chart for explaining an operation of a control system of the color printer or the color copying machine according to Embodiment Modes 1 to 3 of the present invention.

FIG. 7 is a flow chart explaining operations of this update control system. Update control operations of the color printer 100 and the color copying machine 102 according to Embodiment Mode 1 will be hereinafter described in accordance with this flow chart.

Embodiment 1

In explaining the update control operations of the color printer 100 and the color copying machine 102 according to Embodiment Mode 1, as an example (Embodiment 1) thereof, a case will be described in which the image forming apparatus is mounted with the developing device 13BK corresponding to the black toner BK as the first developing device 13(1), the developing device 13Y corresponding to the yellow toner Y as the second developing device 13(2), the developing device 13M corresponding to the magenta toner M as the third developing device 13(3), and the developing device 13C corresponding to the cyan toner C as the fourth developing device 13(4) as shown in FIG. 3A in an initial state of development and, thereafter, the first developing device 13(1) is changed from the developing device 13BK corresponding to the black toner BK to the developing device 13E corresponding to the foamable toner E as shown in FIG. 3B.

Note that, hereinafter, a description will be made of a case where the developing device 13BK corresponding to the black toner BK is replaced with the developing device 13E corresponding to the foamable toner E. However, the present invention is not limited thereto and it is possible to appropriately select a developing device for the replacement depending upon the image to be obtained. Therefore, it is possible to replace a developing device corresponding to another toner. For example, the developing device 13Y corresponding to the yellow toner Y is replaced with the developing device 13E corresponding to the foamable toner E.

Figure 8:
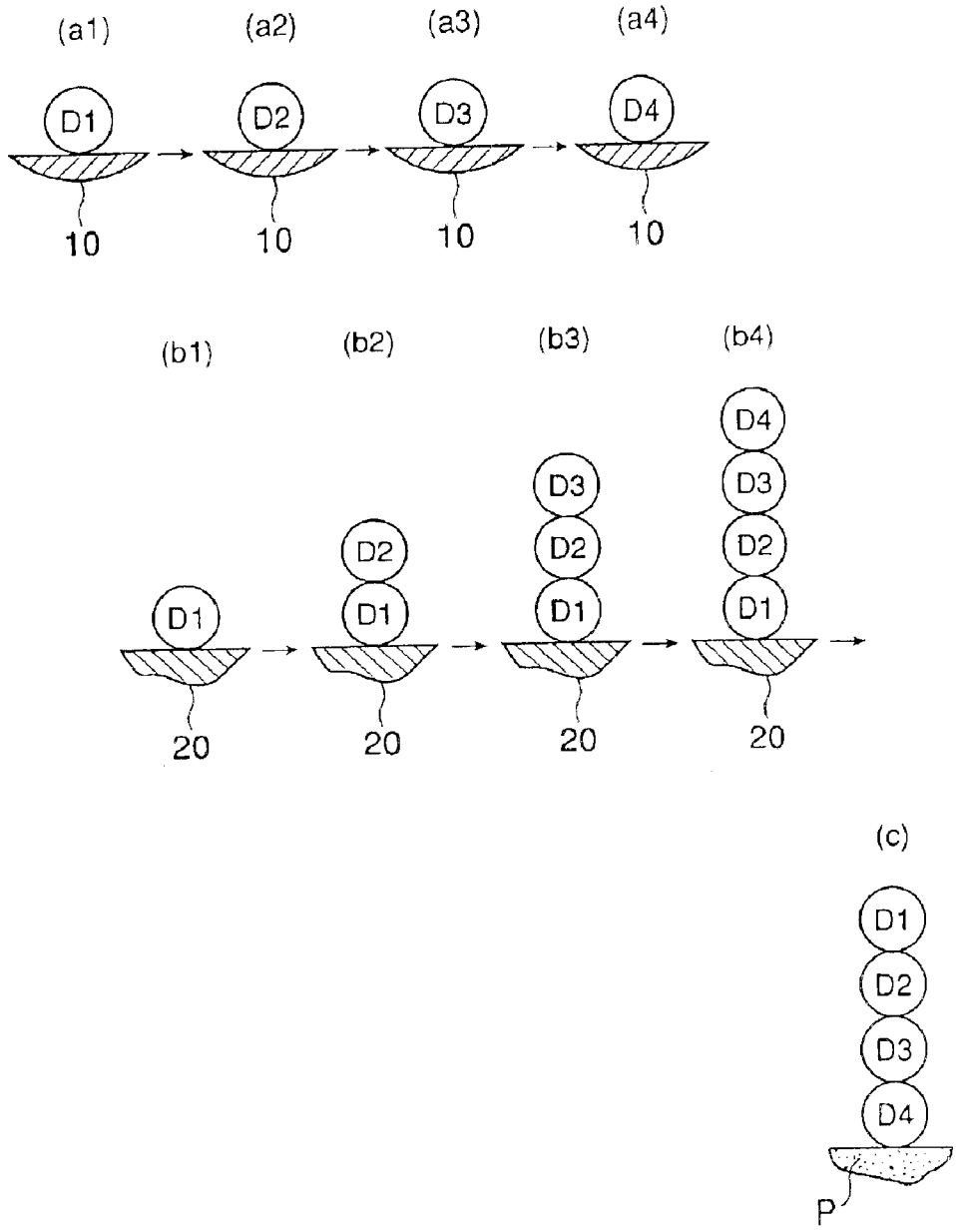

FIGS. 8A1 to 8A4, 8B1 to 8B4, and 8C illustrate steps of forming and stacking toner images in the color printer 100 and the color copying machine 102 according to Embodiment Mode 1. FIGS. 8A1 to 8A4 illustrate steps of forming toner images D1 to D4 on the photosensitive drum 10. FIGS. 8B1 to 8B4 illustrate steps of forming and stacking the toner images D1 to D4 on the intermediate transfer belt 20. FIG. 8C illustrates a step of stacking the toner images D1 to D4 on the recording paper P.

In this embodiment, the toner image (D1) formed of the black toner BK, the toner image (D2) formed of the yellow toner Y, the toner image (D3) formed of the magenta toner M, and the toner image (D4) formed of the cyan toner C are developed on the photosensitive drum 10 sequentially in the development region D, respectively, in the initial state (see FIGS. 1 and 2). These toner images are primarily transferred onto the intermediate transfer belt 20 sequentially in the primary transfer position T1. Finally, the toner image (D1) formed of the black toner BK, the toner image (D2) formed of the yellow toner Y, the toner image (D3) formed of the magenta toner M, and the toner image (D4) formed of the cyan toner C are stacked from a bottom layer to a top layer on the intermediate transfer belt 20. The stacked toner images are secondarily transferred onto the recording paper P in the secondary transfer position T2 at one time. As a result, the toner image (D4) formed of the cyan toner C, the toner image (D3) formed of the magenta toner M, the toner image (D2) formed of the yellow toner Y, and the toner image (D1) formed of the black toner BK are stacked from a bottom layer to a top layer on the recording paper P.

Next, after changing the first developing device 13(1) from the developing device 13BK to the developing device 13E, when an image is formed, the update control operation shown in the flow chart of FIG. 7 is performed.

First, the control unit 70 judges whether or not the developing device (second developing unit) 13E is mounted on the developing apparatus 13(S1 in FIG. 7). That is, in the case where the first button 13*a* is "OFF" and the second button 13*b* is "ON", when the developing device 13E is mounted, the control unit 70 judges that the developing device 13E is mounted (see FIG. 5B).

In the case where the developing device 13E is mounted, the control unit 70 judges whether or not the developing device (second developing unit) 13E is used (S2 in FIG. 7). In the case of the color printer 100, judgement is made based on whether or not a three-dimensional image forming command is included in an image forming command from a personal computer or the like connected to the color printer 100. Alternatively, in the case of the color copying machine 102, judgment is made based on whether or not a three-dimensional image forming command has been inputted directly from a user via the user interface device 102.

If the developing device 13E is used, the control unit 70 updates an order of image formation of the image forming apparatus (S3 in FIG. 7). That is, the control unit 70 sends a drive command to the developing motor 13*m*, thereby updating the order of image formation as follows: before replacing a developing device, the control unit 70 moves the developing devices 13(1) to 13(4) to the development region D opposed to the photosensitive drum 10 in the order of the first developing device 13(1) (=13BK), the second developing device 13(2) (=13Y), the third developing device 13(3) (=13M), and the fourth developing device 13(4) (=13C) to develop images by the developing devices 13(1) to 13(4), whereas, after replacing the developing device, the control unit 70 moves the developing devices 13(1) to 13(4) to the development region D opposed to the photosensitive drum 10 in the order of the second developing device 13(2) (=13Y), the third developing device 13(3) (=13M), the fourth developing device 13(4) (=13C), and the first developing device 13(1) (=13E) to develop images by the developing devices 13(1) to 13(4).

By updating an order of image formation as described above, after replacing the developing device, the toner image (D1) formed of the yellow toner Y, the toner image (D2) formed of the magenta toner M, the toner image (D3) formed of the cyan toner C, and the toner image (D4) formed of the foamable toner E are developed on the photosensitive drum 10 sequentially in the development region D, respectively, (see FIGS. 1 and 2). These toner images are primarily transferred onto the intermediate transfer belt 20 sequentially in the primary transfer position T1. Finally, the toner image (D1) formed of the yellow toner Y, the toner image (D2) formed of the magenta toner M, the toner image (D3) formed of the cyan toner C, and the toner image (D4) formed of the foamable toner E are laminated from a bottom layer to a top layer on the intermediate transfer belt 20. The laminated toner images are secondarily transferred onto the recording paper P in the secondary transfer position T2 at one time. As a result, the toner image (D4) formed of the foamable toner E, the toner image (D3) formed of the cyan toner C, the toner image (D2) formed of the magenta toner M, and the toner image (D1) formed of the yellow toner Y, are laminated from a bottom layer to a top layer on the recording paper P. That is, the toner image (D4) formed of the foamable toner E always constitutes the lowermost layer.

In addition, in the case where the developing device 13E is used, the control unit 70 updates image processing parameters of the image forming apparatus (S4 in FIG. 7). That is, the control unit 70 sends an image processing update command to the image processing apparatus 30, thereby first changing a type of gradation data, and secondly performing image processing such that a toner image formed of the other toners Y to C is not formed in the outline part (over a very small width) of the toner image with the foamable toner E.

Here, a type of gradation data is changed for the purpose of performing image processing such that: gradation data of so-called process black is obtained in which gradation data of yellow (Y), magenta (M), and cyan (C) is used instead of obtaining gradation data of single black (BK) and performing image processing, whereas, before replacing the developing device, gradation data of four colors of yellow (Y), magenta (M), cyan (C), and black (BK) (8 bits each) is obtained from reflectance data of the original d; and gradation data is newly generated for a three-dimensional image.

In addition, image processing as described below is performed in order not to form a toner image formed of the other toners Y to C in the outline part of the toner image formed of the foamable toner E, or in order to form a toner image formed of the other toners Y to C only on the upper surface of the toner image formed of the foamable toner E and in order not to form a toner image formed of the other toners Y to C on the side (slant surface) of the image with the foamable toner E.

Figure 9:
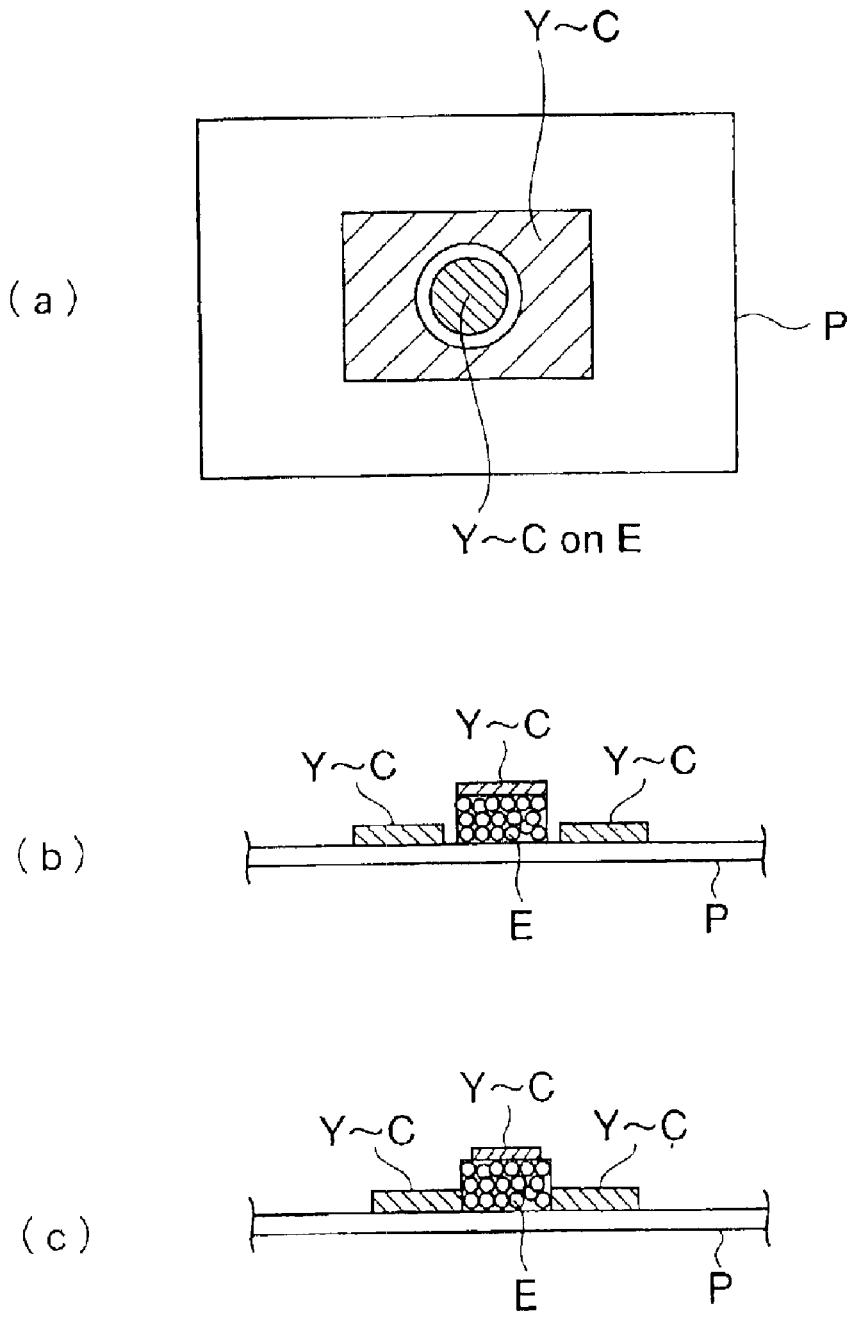
FIGS. 9A to 9C are used for explaining an image processing control of the color printer according to Embodiment Modes 1 to 5 of the present invention.

A toner image formed of the toners Y, M, and C, and the foamable toner E, which is secondarily transferred onto the recording paper P, is not formed in the same manner as a normal full-color image. Image processing is performed such that a toner image formed of the toners Y, M, and C is not formed over a predetermined very small width (about several $\mu$m to 40 $\mu$m) in an outline part of a three-dimensional image, which is formed with the foamable toner E subsequent to forming the toner image formed of the toners Y, M, and C, as shown in FIG. 9A. More specifically, the image processing is adapted such that an edge part of a three-dimensional image is detected by an edge detection circuit of the image processing apparatus 30 and gradation data of Y, M, and C is not generated over a predetermined very small width in the edge part of the three-dimensional image. In this case, in the edge part of three-dimensional image, a gap may be set over a predetermined very small width in the external periphery of the three-dimensional image as shown in FIG. 9B. Alternatively, a gap may be set over a predetermined very small width in the internal periphery of the three-dimensional image as shown in FIG. 9C.

By performing such image processing, a gap with a very small width is formed in the outline part of the three-dimensional image formed of the foamable toner E. Thus, even if a supporting body such as the recording paper P is bent, an unbearable tension or compressive force does not act on the toner image formed of the toners Y, M, and C formed in the outline part of the three-dimensional image, and the toner image formed of the toners Y, M, and C is not destroyed. Therefore, it becomes possible to form a three-dimensional full-color image having sufficient durability at low costs.

In addition, in the case where the developing device 13E is used, the control unit 70 updates electrophotographic process parameters of the image forming apparatus (S5 in FIG. 7). That is, the control unit 70 sends a charging bias update command, a developing bias update command, a primary transfer bias update command, a secondary transfer bias update command, a drive command, and a heating power update command to the charging power supply section 11*p*, the developing power supply section 13*p*, the primary transfer power supply section 15*p*, the secondary transfer power supply section 15*p*, the fixing motor 50*m*, and the heating power supply section 51*p*, respectively.

Thus, it is possible to control: a charging potential and a developing bias on the photosensitive drum 10 when the developing device 13E performs development; a primary transferring bias when the toner image formed of the foaming toner E is primarily transferred; a secondary transferring bias when the toner image with the foaming toner E is secondary transferred; and a fixing rate and a fixing temperature when the toner image with the foaming toner E is fixed. At this time, the fixing temperature and the fixing rate can be changed in accordance with the materials of the foaming toner E and the normal toner, the image quality of the toner image to be obtained, the height of the three-dimensional image after expansion, and the like. Also, one or both of the fixing temperature and the fixing rate can be changed. In this case, the fixing rate of only the foaming toner E can be reduced to 20% to 95% of the fixing rate of only the normal toner, and the fixing temperature of only the foaming toner E can be increased to 5% to 40% of the fixing temperature of only the normal toner.

After the above-mentioned image forming orders, image processing parameters, and electrophotographic process parameters have been automatically updated and determined, the control unit 70 performs image formation (S6 in FIG. 7). Here, the height of the toner image consisting of this unfixed foamable toner E is 55 to 60 $\mu$m. Thereafter, fixing processing is performed with heat and pressure by the heating roll 31 and the pressure roll 32 of fixing device 30, so that the binder resin within the foamable toner E is fused and the foaming agent within the formable toner E is foamed. Thus, the three-dimensional image and the full-color image in Y, M, and C are fixed onto the recording paper P. The three-dimensional image fixed onto the recording paper P are expanded to have a height of 130 $\mu$m. Note that, the fixing process is performed under the condition that the fixing temperature is 150° C., the nip width between the heating roll 51 and the pressure roll 52 is 4.8 mm, and the fixing rate is 35 mm/sec.

Note that, although an order of development is automatically determined according to a type of a mounted developing device in Embodiment 1, the image forming apparatus can be constituted such that a user can determine the order of development personally via the user interface device (user interface section) 80.

Note that, although the case where the developing device 13BK corresponding to the black toner BK forming the uppermost layer (see D1 in FIG. 8) on the recording paper P is replaced with the developing device 13E corresponding to the foamable toner E, which should form the lowermost layer (see D4 in FIG. 8) on the recording paper P, is described in Embodiment 1, other examples are shown in Embodiments 2 to 6 in Tables 1 and 2.

TABLE 1

| | D1 | D2 | D3 | D4 |
|---|---|---|---|---|
| Embodiment 1 | BK | Y | M | C |
| Embodiment 2 | BK | Y | C | M |
| Embodiment 3 | BK | M | Y | C |
| Embodiment 4 | BK | M | C | Y |
| Embodiment 5 | BK | C | Y | M |
| Embodiment 6 | BK | C | M | Y |

Table 1 shows combinations of the toner images D1 to D4 before replacing a developing device. Table 2 shows combinations of the toner images D1 to D4 after replacing the developing device. Moreover, the developing device 13 corresponding to the toner forming the layers other than the uppermost layer (see D2, D3, and D4 in FIG. 8) on the recording paper P can also be replaced with the developing device 13E corresponding to the foamable toner E that should constitute the lowermost layer (see D4 in FIG. 8) on the recording paper P.

Embodiment Mode 2

In the color printer 100 and the color copying machine 102 according to Embodiment Mode 2, instead of one of the developing devices (first developing units) 13Y to 13BK corresponding to the toners (first developer including no foaming agent and including a colorant of a nonmetallic color) in the respective colors of yellow (Y), cyan (C), magenta (M), and black (BK), developing device (second developing unit) 13G corresponding to gold toner G (second developer including no foaming agent and including a colorant of a metallic color) can be mounted to the apparatus. Note that the structural members identical to those of the color printer 100 and the color copying machine 102 according to Embodiment Mode 1 are denoted by the same symbols and a description thereof will be omitted.

Figure 10:
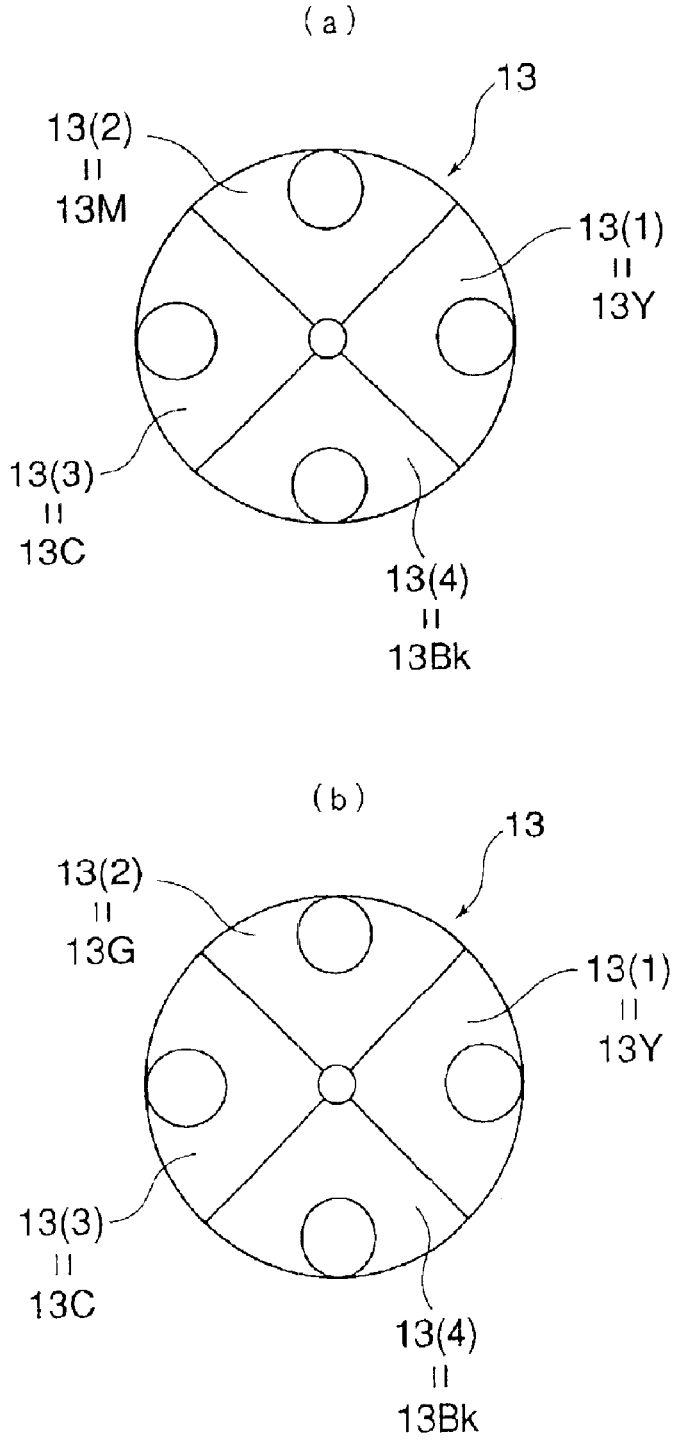
FIGS. 10A and 10B are cross-sectional schematic views for explaining a rotary developing apparatus of the color printer or the color copying machine according to Embodiment Mode 2 of the present invention.

As shown in FIGS. 10A and 10B, this rotary developing apparatus 13 is provided with first to fourth developing devices 13(1) to 13(4) that are different from each other in each of regions that are obtained by dividing the apparatus into four fan shapes about the rotation axis. As shown in FIG. 4, the developing devices 13(1) to 13(4) are structured to be detachably mountable and to be able to slide along a guide rail that is provided to the developing devices 13(1) to 13(4) and is parallel to the rotation axis and a guide rail support that is provided to the developing apparatus main body so as to face the guide rail by exerting a force in the directions B or A in the drawing with respect to the developing apparatus main body.

Thus, in the color printer 100 and the color copying machine 102 which use only normal toners in yellow (Y), cyan (C), magenta (M), and black (BK), it is possible to form an image by using the special gold toner G by only replacing developing devices.

Embodiment 7

Prior to a description of the update control operation of the color printer 100 and the color copying machine 102 according to Embodiment Mode 2, as an example thereof (Embodiment 7), a description will be given of the following case. That is, in an initial state, as shown in FIG. 10A, there are mounted the developing device 13Y corresponding to the yellow toner Y as the first developing device 13(1), the developing device 13M corresponding to the magenta toner M as the second developing device 13(2), the developing device 13C corresponding to the cyan toner C as the third developing device 13(3), and the developing device 13BK corresponding to the black toner BK as the fourth developing device 13(4). Thereafter, as shown in FIG. 10B, the developing device 13M corresponding to the magenta toner M is replaced with the developing device 13G corresponding to the gold toner G as the second developing device 13(2).

Note that, hereinafter, a description will be given of the case in which the developing device 13M corresponding to the magenta toner M is replaced with the developing device 13G corresponding to the gold toner G. However, the present invention is not limited to this case and the developing device can be appropriately selected according to the image to be obtained. Thus, the developing device 13Y corresponding to other toners, e.g., yellow toner Y can be replaced with the developing device 13G corresponding to the gold toner G as well.

In this embodiment, the toner image (D1) formed of the yellow toner Y, the toner image (D2) formed of the magenta toner M, the toner image (D3) formed of the cyan toner C, and the toner image (D4) formed of the black toner BK are developed on the photosensitive drum 10 sequentially in the development region D, respectively, in the initial state (see FIGS. 1 and 2, and FIGS. 8A1 to 8A4). These toner images are primarily transferred onto the intermediate transfer belt 20 sequentially in the primary transfer position T1. Finally, the toner image (D1) formed of the yellow toner Y, the toner image (D2) formed of the magenta toner M, the toner image (D3) formed of the cyan toner C, and the toner image (D4) formed of the black toner BK are laminated from a bottom layer to a top layer on the intermediate transfer belt 20 (see FIGS. 1, 2, and 8B4). The stacked toner images are secondarily transferred onto the recording paper P in the secondary transfer position T2 at one time. As a result, the toner image (D4) formed of the black toner BK, the toner image (D3) formed of the cyan toner C, the toner image (D2) formed of the magenta toner M, and the toner image (D1) formed of the yellow toner Y are stacked from a bottom layer to a top layer on the recording paper P (see FIGS. 1, 2, and 8C).

Next, after changing the second developing device 13(2) from the developing device 13M to the developing device 13G, when an image is formed, the update control operation shown in the flow chart of FIG. 7 is performed as in Embodiment Mode 1.

Here, the control unit 70 sends a drive command to the developing motor 13*m*, thereby updating the order of image formation as follows: before replacing a developing device, the control unit 70 moves the developing devices 13(1) to 13(4) to the development region D opposed to the photosensitive drum 10 in the order of the first developing device 13(1) (13Y), the second developing device 13(2) (13M), the third developing device 13(3) (13C), and the fourth developing device 13(4) (13BK) to develop images by the developing device 13(1) to 13(4), whereas, after replacing the developing device, the control unit 70 moves the developing devices 13(1) to 13(4) to the development region D opposed to the photosensitive drum 10 in the order of the second developing device 13(2) (13G), the first developing device 13(1) (13Y), the third developing device 13(3) (13C), and the fourth developing device 13(4) (13BK) to develop images by the developing devices 13(1) to 13(4).

By updating an order of image formation as described above, after replacing a developing device, the toner image (D1) formed of the gold toner G, the toner image (D2) formed of the yellow toner Y, the toner image (D3) formed of the cyan toner C, and the toner image (D4) formed of the black toner BK are developed on the photosensitive drum 10 sequentially in the development region D, respectively (see FIGS. 1 and 2). These toner images are primarily transferred onto the intermediate transfer belt 20 sequentially in the primary transfer position T1. Finally, the toner image (D1) formed of the gold toner G, the toner image (D2) formed of the yellow toner Y, the toner image (D3) formed of the cyan toner C, and the toner image (D4) formed of the black toner BK are stacked from a bottom layer to a top layer on the intermediate transfer belt 20. The stacked toner images are secondarily transferred onto the recording paper P in the secondary transfer position T2 at one time. As a result, the toner image (D4) formed of the black toner BK, the toner image (D3) formed of the cyan toner C, the toner image (D2) formed of the yellow toner Y, and the toner image (D1) formed of the gold toner G, are stacked from a bottom layer to a top layer on the recording paper P. That is, the toner image (D1) formed of the gold toner G always constitutes the uppermost layer.

In addition, in the case where the developing device 13G is used, the control unit 70 updates image processing parameters of the image forming apparatus (S4 in FIG. 7). That is, the control unit 70 sends an image processing update command to the image processing apparatus 30, thereby changing a type of gradation data.

Here, a type of gradation data is changed for the purpose of performing image processing such that: gradation data of gold G is newly generated without generating gradation data of magenta (M), whereas, before replacing the developing device, gradation data of four colors of yellow (Y), magenta (M), cyan (C), and black (BK) (8 bits each) is obtained from reflectance data of the original d.

In addition, in the case where the developing device 13G is used, the control unit 70 updates electrophotographic process parameters of the image forming apparatus (S5 in FIG. 7). That is, the control unit 70 sends a charging bias update command, a developing bias update command, a primary transfer bias update command, a secondary transfer bias update command, a drive command, and a heating power update command to the charging power supply section 11*p*, the developing power supply section 13*p*, the primary transfer power supply section 15*p*, the secondary transfer power supply section 23*p*, the fixing motor 50*m*, and the heating power supply section 51*p*, respectively.

Thus, it is possible to control: a charging potential and a developing bias on the photosensitive drum 10 when the developing device 13G performs development; a primary transferring bias when the toner image formed of the gold toner G is primarily transferred; a secondary transferring bias when the toner image with the gold toner G is primarily transferred; and a fixing rate and a fixing temperature when the toner image with the gold toner G is fixed. At this time, the fixing temperature and the fixing rate can be changed in accordance with the materials of the gold toner G and the normal toner, the image quality of the toner image to be obtained, the height of the three-dimensional image after expansion, and the like. Also, one or both of the fixing temperature and the fixing rate can be changed. In this case, the fixing rate of only the gold toner G can be reduced to 20% to 95% of the fixing rate of only the normal toner, and the fixing temperature of only the gold toner G can be increased to 5% to 40% of the fixing temperature of only the normal toner.

After the above-mentioned image forming orders, image processing parameters, and electrophotographic process parameters have been automatically updated and determined, the control unit 70 performs image formation (S6 in FIG. 7).

Note that in Embodiment 7, even after the developing device 13(2) is replaced, the developing devices 13Y and 13C corresponding to the other color toners (yellow (Y) and cyan (C)) are used. However, after replacement of the developing device 13(2), it is also possible to dispense with the developing devices 13Y and 13C under control. In this case, after the replacement of the developing device, the second developing device 13(2) (13G) and the fourth developing device 13(4) (13BK) are moved in this order to the development region D facing the photosensitive drum 10 and are used for development.

Note that, although the case where the developing device 13M corresponding to the magenta toner M forming the second layer from the uppermost layer (see FIG. 8D2) on the recording paper P is replaced with the developing device 13G corresponding to the gold toner G, which should form the uppermost layer (see FIG. 8D1) on the recording paper P, is described in Embodiment 7, other examples are shown in Embodiments 8 to 12 in Tables 3 and 4.

TABLE 3

| | D1 | D2 | D3 | D4 |
|---|---|---|---|---|
| Embodiment 7 | Y | M | C | BK |
| Embodiment 8 | Y | C | M | BK |
| Embodiment 9 | M | Y | C | BK |
| Embodiment 10 | M | C | Y | BK |
| Embodiment 11 | C | Y | M | BK |
| Embodiment 12 | C | M | Y | BK |

TABLE 4

| | D1 | D2 | D3 | D4 |
|---|---|---|---|---|
| Embodiment 7 | Y | G | C | BK |
| Embodiment 8 | Y | G | M | BK |
| Embodiment 9 | M | G | C | BK |
| Embodiment 10 | M | G | Y | BK |
| Embodiment 11 | C | G | M | BK |
| Embodiment 12 | C | G | Y | BK |

Table 3 shows combinations of the toner images D1 to D4 before replacing a developing device. Table 4 shows combinations of the toner images D1 to D4 after replacing the developing device. Moreover, the developing device 13 corresponding to the toner forming the layers other than the second layer from the uppermost layer (see FIGS. 8D1, 8D3, and 8D4) on the recording paper P can also be replaced with the developing device 13G corresponding to the gold toner G that should constitute the uppermost layer (see FIG. 8D1) on the recording paper P.

Embodiment Mode 3

In the color printer 100 and the color copying machine 102 according to Embodiment Mode 3, the respective developing devices (first developing units) 13Y to 13C corresponding to the toners (first developers including not foaming agent but colorant of nonmetallic color) of the respective colors of yellow (Y), magenta (M), and cyan (C) and in addition, the developing device (second developing unit) 13E corresponding to the foaming toner E (second developer including not the colorant but the foaming agent) can be mounted. Further, the developing device (second developing unit) 13G corresponding to the gold toner G (second developer including not the foaming agent but the colorant of metallic color) can be mounted thereto. Note that the same structural members as those in the color printer 100 and the color copying machine 102 according to Embodiment Mode 1 or 2 are denoted by the same symbols and a description thereof is omitted.

Figure 11:
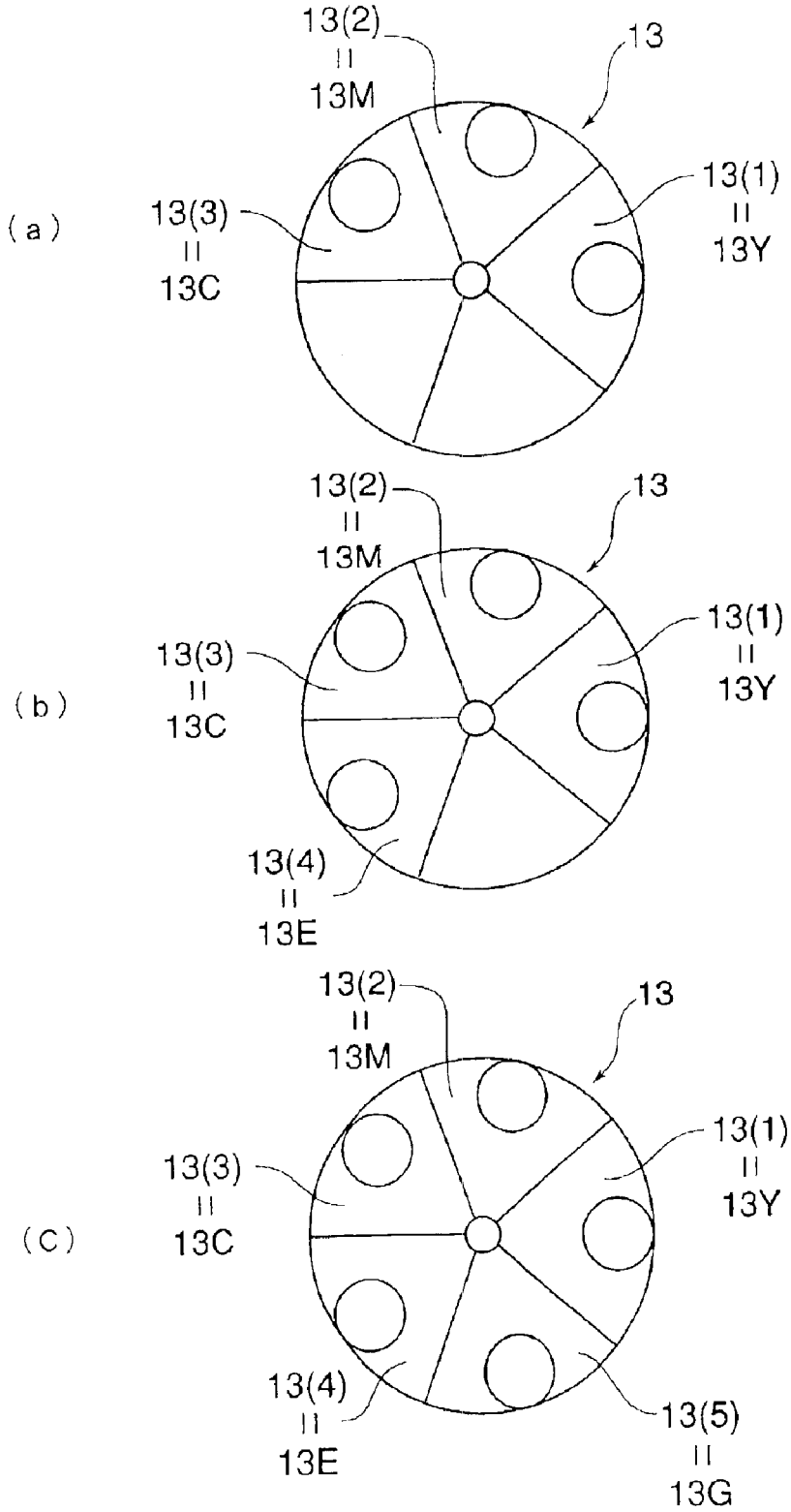
FIGS. 11A to 11C are cross-sectional schematic views for explaining a rotary developing apparatus of the color printer or the color copying machine according to Embodiment Mode 3 of the present invention.
Figure 12:
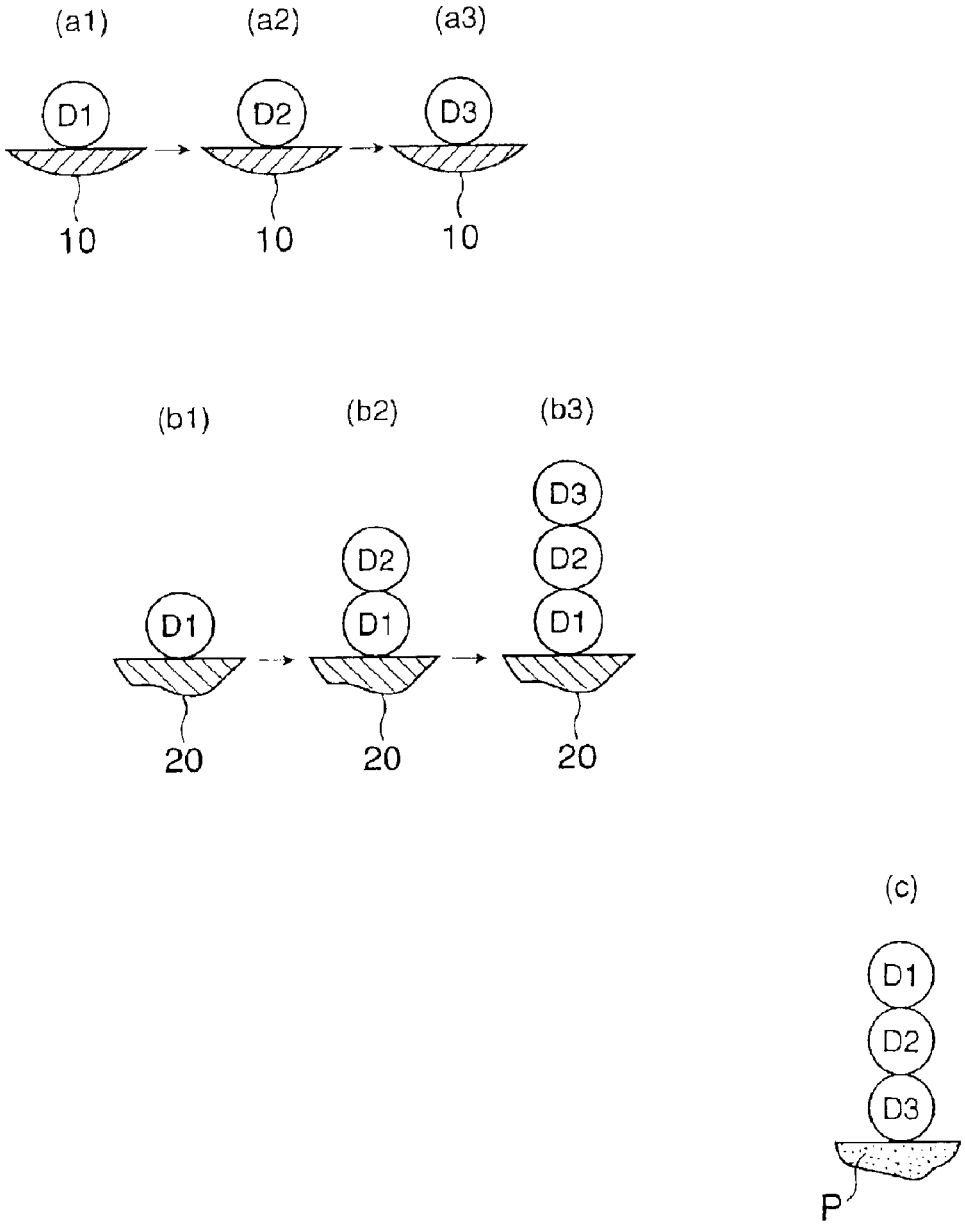

As shown in FIGS. 11A to 11C, this rotary developing apparatus 13 is provided with first to fifth developing devices 13(1) to 13(5) that are different from each other in each of regions that are obtained by dividing the apparatus into five fan shapes about the rotation axis. As shown in FIG. 4, the developing devices 13(1) to 13(5) are structured to be detachably mountable and to be able to slide along a guide rail that is provided to the developing devices 13(1) to 13(5) and is parallel to the rotation axis and a guide rail support that is provided to the developing apparatus main body so as to face the guide rail by exerting a force in the direction B or A in the drawing with respect to the developing apparatus main body.

Thus, in the color printer 100 and the color copying machine 102 which use only normal toners in yellow (Y), magenta (M), and cyan (C), it is possible to form an image by using the special foamable toner E and gold toner G by only adding developing devices.

Embodiment 13

Prior to a description of the update control operation of the color printer 100 and the color copying machine 102 according to Embodiment Mode 2, as an example thereof (Embodiment 13), a description will be given of the following case. That is, in an initial state, as shown in FIG. 1A, there are mounted the developing device 13Y corresponding to the yellow toner Y as the first developing device 13(1), the developing device 13M corresponding to the magenta toner M as the second developing device 13(2), and the developing device 13C corresponding to the cyan toner C as the third developing device 13(3). Thereafter, as shown in FIG. 11B, there is mounted the developing device 13E corresponding to the foamable toner E as the fourth developing device 13(4). Further, as shown in FIG. 11C, there is mounted the developing device 13G corresponding to the gold toner G as the fifth developing device 13(5).

In this embodiment, the toner image (D1) formed of the yellow toner Y, the toner image (D2) formed of the magenta toner M, and the toner image (D3) formed of the cyan toner C are developed on the photosensitive drum 10 sequentially in the development region D, respectively, in the initial state (see FIGS. 1 and 2, and FIGS. 12A1 to 12A3). These toner images are primarily transferred onto the intermediate transfer belt 20 sequentially in the primary transfer position T1 (see FIGS. 12B1 and 12B2). Finally, the toner image (D1) formed of the yellow toner Y, the toner image (D2) formed of the magenta toner M, and the toner image (D3) formed of the cyan toner C are stacked from a bottom layer to a top layer on the intermediate transfer belt 20 (see FIGS. 1, 2 and 12B3). The stacked toner images are secondarily transferred onto the recording paper P in the secondary transfer position T2 at one time. As a result, the toner image (D3) formed of the cyan toner C, the toner image (D2) formed of the magenta toner M, and the toner image (D1) formed of the yellow toner Y are stacked from a bottom layer to a top layer on the recording paper P (see FIGS. 1, 2, and 12C).

Next, in the case where the developing device 13E is added into the empty fourth developing device 13(4) for image formation, the update control operation as shown in the flow chart of FIG. 7 is performed similarly to Embodiment Mode 1.

Here, the control unit 70 transmits the drive command to the developing motor 13*m*, so that after the addition of the developing device, the first developing device 13(1) (13Y), the second developing device 13(2) (13M), the third developing device 13(3) (13C), and the fourth developing device 13(4) (13E) are moved in this order to the development region D facing the photosensitive drum 10 and are used for development.

By updating an order of image formation as described above, after replacing a developing device, the toner image (D1) formed of the yellow toner Y, the toner image (D2) formed of the magenta toner M, the toner image (D3) formed of the cyan toner C, and the toner image (D4) formed of the foamable toner E are developed on the photosensitive drum 10 sequentially in the development region D, respectively (see FIGS. 1 and 2). These toner images are primarily transferred onto the intermediate transfer belt 20 sequentially in the primary transfer position T1 (see FIGS. 8B1 to 8B3). Finally, the toner image (D1) formed of the yellow toner Y, the toner image (D2) formed of the magenta toner M, the toner image (D3) formed of the cyan toner C, and the toner image (D4) formed of the foamable toner E are stacked from a bottom layer to a top layer on the intermediate transfer belt 20. The stacked toner images are secondarily transferred onto the recording paper P in the secondary transfer position T2 at one time. As a result, the toner image (D4) formed of the foamable toner E, the toner image (D3) formed of the cyan toner C, the toner image (D2) formed of the magenta toner M, and the toner image (D1) formed of the yellow toner Y, are stacked from a bottom layer to a top layer on the recording paper P. That is, the toner image (D4) formed of the foamable toner E always constitutes the lowermost layer.

Further, when the developing device 13E is used, similarly to Embodiment Mode 1, the control unit 70 updates the image processing parameter (S4 in FIG. 7) and the electrophotographic process parameter (S5 in FIG. 7) of the image forming apparatus. After the image formation order, the image processing parameter, and the electrophotographic process parameter are automatically updated and determined, the control unit 70 performs image formation (S6 in FIG. 7).

Next, in the case where the developing device 13G is added into the empty fourth developing device 13(5) for image formation, the update control operation as shown in the flow chart of FIG. 7 is performed similarly to Embodiment Mode 2.

Here, the control unit 70 transmits the drive command to the developing motor 13*m*, so that after the further addition of the developing device, the fifth developing device 13(5) (13G), the first developing device 13(1) (13Y), the second developing device 13(2) (13M), the third developing device 13(3) (13C), and the fourth developing device 13(4) (13E) are moved in this order to the development region D facing the photosensitive drum 10 and are used for development.

By updating an order of image formation as described above, after replacing a developing device, the toner image (D1) formed of the gold toner G, the toner image (D2) formed of the yellow toner Y, the toner image (D3) formed of the magenta toner M, the toner image (D4) formed of the cyan toner C, and the toner image (D5) formed of the foamable toner E are developed on the photosensitive drum 10 sequentially in the development region D, respectively (see FIGS. 1 and 2, and FIGS. 13A1 to 13A5). These toner images are primarily transferred onto the intermediate transfer belt 20 sequentially in the primary transfer position T1 (see FIGS. 13B1 to 13B4). Finally, the toner image (D1) formed of the gold toner G, the toner image (D2) formed of the yellow toner Y, the toner image (D3) formed of the magenta toner M, the toner image (D4) formed of the cyan toner C, and the toner image (D5) formed of the foamable toner E are stacked from a bottom layer to a top layer on the intermediate transfer belt 20 (see FIG. 13B5). The stacked toner images are secondarily transferred onto the recording paper P in the secondary transfer position T2 at one time. As a result, the toner image (D5) formed of the foamable toner E, the toner image (D4) formed of the cyan toner C, the toner image (D3) formed of the magenta toner M, the toner image (D2) formed of the yellow toner Y, and the toner image (D1) formed of the gold toner G, are stacked from a bottom layer to a top layer on the recording paper P. That is, the toner image (D5) formed of the foamable toner E always constitutes the lowermost layer and the toner image (D1) formed of the gold toner G always constitutes the uppermost layer.

Further, when the developing device 13G is used, similarly to Embodiment Mode 2, the control unit 70 updates the image processing parameter (S4 in FIG. 7) and the electrophotographic process parameter (S5 in FIG. 7) of the image forming apparatus. After the image formation order, the image processing parameter, and the electrophotographic process parameter are automatically updated and determined, the control unit 70 performs image formation (S6 in FIG. 7).

Note that in Embodiment 13, the description is given assuming that the second layer, the third layer, and the fourth layer are used for the yellow toner Y, the magenta toner M, and the cyan toner C, respectively on the recording paper P as viewed from the uppermost layer. However, another example is shown in Embodiments 14 to 18 using Table 5 to Table 7.

TABLE 5

| | D1 | D2 | D3 |
|---|---|---|---|
| Embodiment 13 | Y | M | C |
| Embodiment 14 | Y | C | M |
| Embodiment 15 | M | Y | C |
| Embodiment 16 | M | C | Y |
| Embodiment 17 | C | Y | M |
| Embodiment 18 | C | M | Y |

TABLE 6

| | D1 | D2 | D3 | D4 |
|---|---|---|---|---|
| Embodiment 13 | Y | M | C | E |
| Embodiment 14 | Y | C | M | E |
| Embodiment 15 | M | Y | C | E |
| Embodiment 16 | M | C | Y | E |
| Embodiment 17 | C | Y | M | E |
| Embodiment 18 | C | M | Y | E |

TABLE 7

| | D1 | D2 | D3 | D4 | D5 |
|---|---|---|---|---|---|
| Embodiment 13 | G | Y | M | C | E |
| Embodiment 14 | G | Y | C | M | E |
| Embodiment 15 | G | M | Y | C | E |
| Embodiment 16 | G | M | C | Y | E |
| Embodiment 17 | G | C | Y | M | E |
| Embodiment 18 | G | C | M | Y | E |

Table 5 shows combinations of the toner images D1 to D3 before the addition of developing devices. Table 6 shows combinations of the toner images D1 to D4 after the addition of (one) developing device. Table 7 shows combinations of the toner images D1 to D5 after the addition of (two) developing devices.

Embodiment Mode 4

In the color printer 100 and the color copying machine 102 according to Embodiment Mode 4, as a substitute for one of the image forming units (first image forming units) 1Y to 1BK corresponding to the toners (first developers including not foaming agent but colorant of nonmetallic color) of the respective colors of yellow (Y), cyan (C), magenta (M), and black (BK), the image forming unit (second image forming unit) 1E corresponding to the foaming toner E (second developer including not the colorant but the foaming agent) can be mounted thereto. Alternatively, the image forming unit (second image forming unit) 1G corresponding to the gold toner G (second developer including not the foaming agent but the colorant of metallic color) can be mounted thereto.

Figure 14:
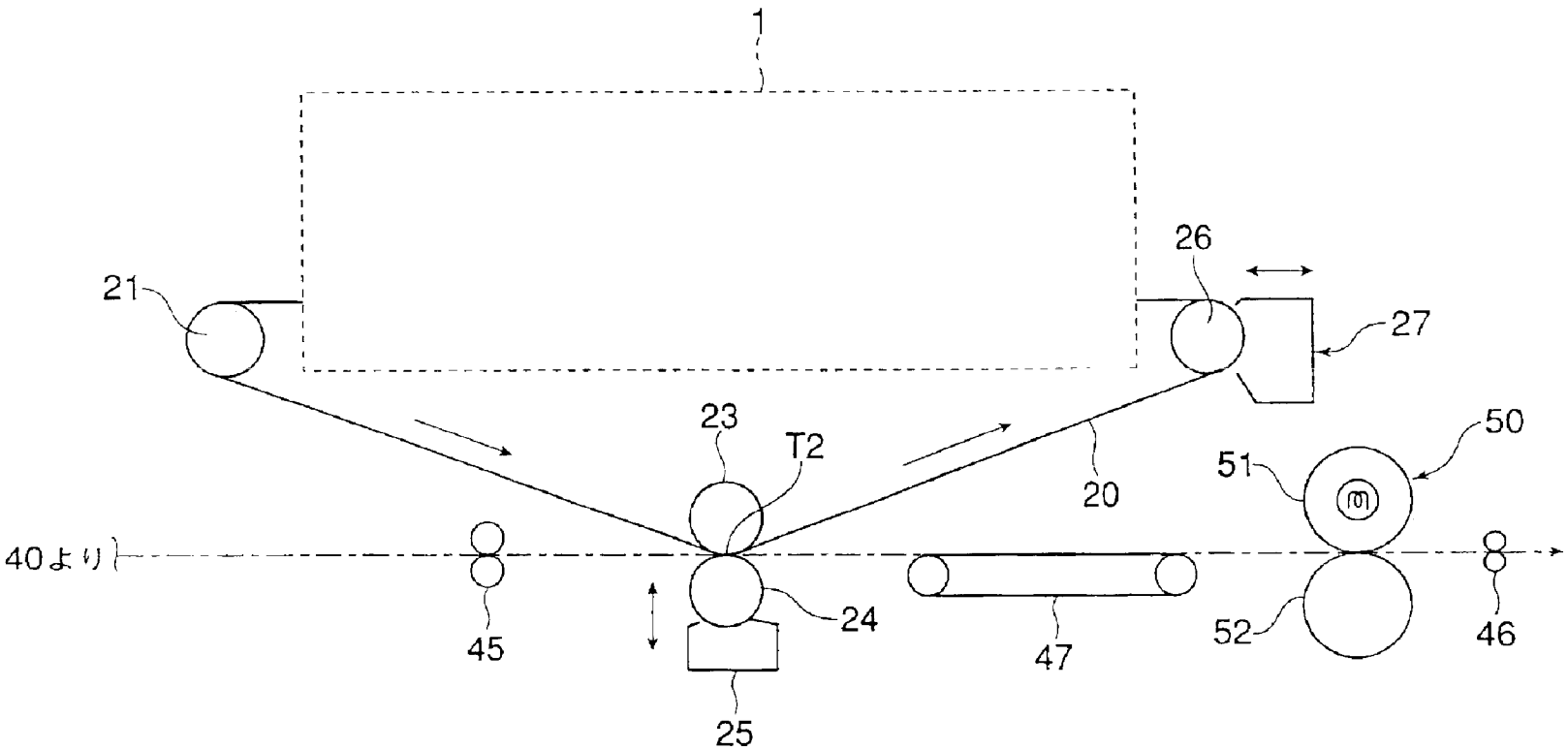
FIG. 14 is a cross-sectional schematic view showing a main part of the color printer or the color copying machine according to Embodiment Modes 4 and 5 of the present invention.
Figure 15:
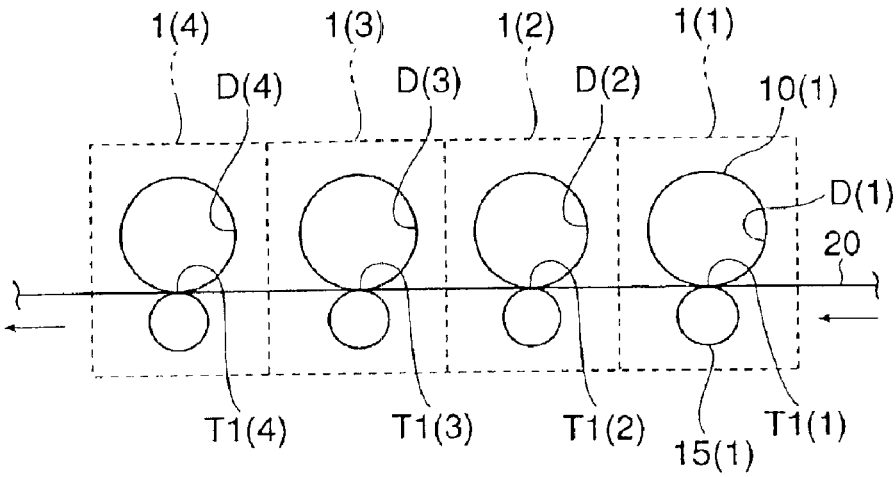
FIGS. 15A and 15B are used for explaining an image forming section of FIG. 14.
Figure 15:
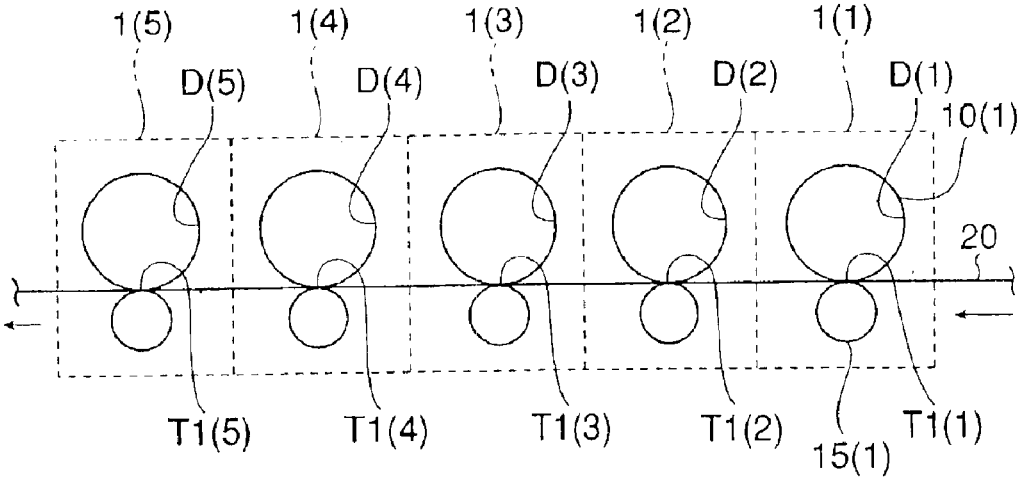
Figure 16:
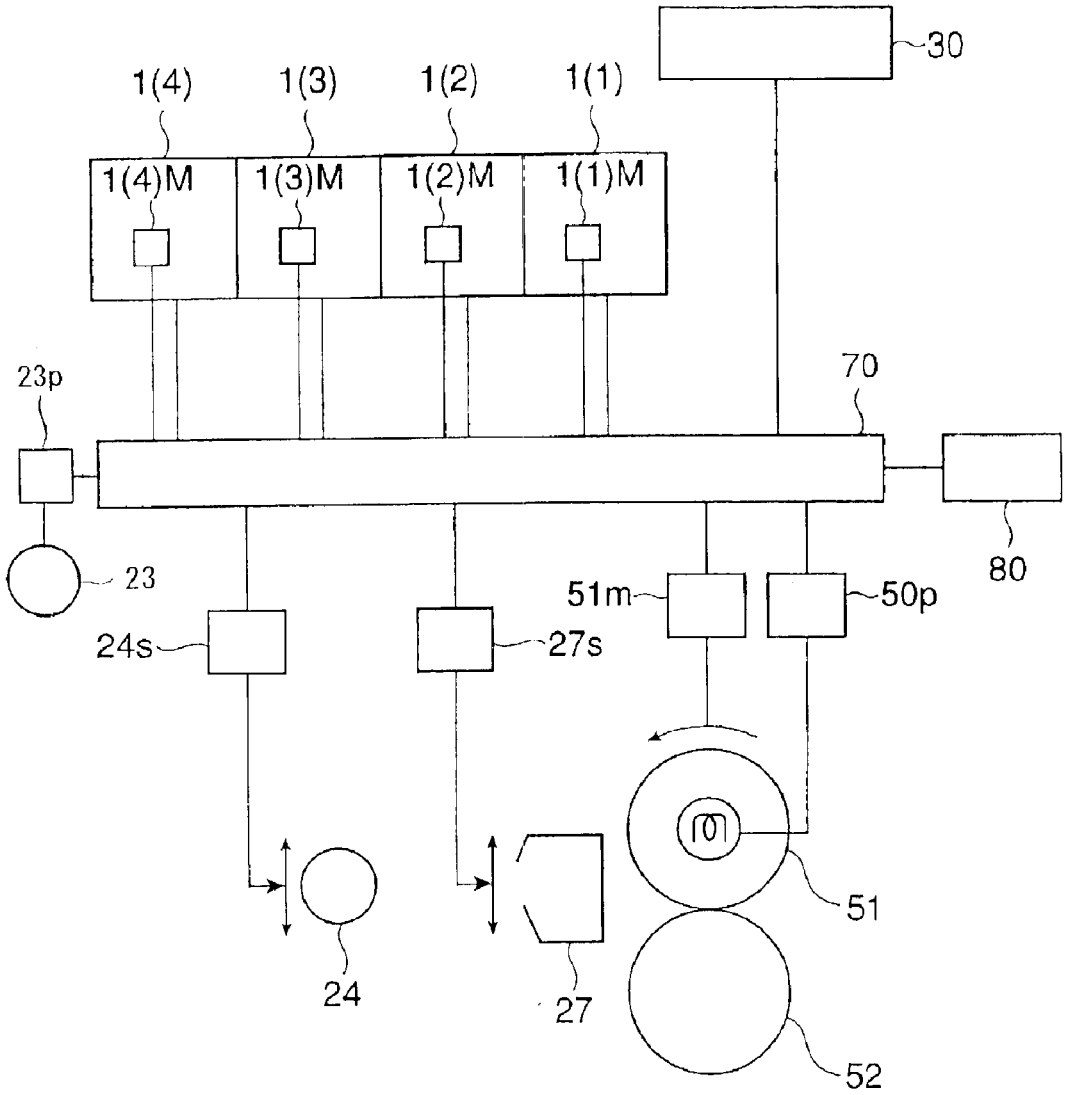
FIG. 16 is a block diagram for explaining a control system of the color printer according to Embodiment Modes 4 and 5 of the present invention.

FIG. 14 shows a main part of the color printer 100 and the color copying machine 102 according to Embodiment Mode 4. FIG. 15A shows the image forming section of the color printer 100 and the color copying machine 102 according to Embodiment Mode 4. FIG. 16 is a functional block diagram illustrating the update control system of the color printer 100 and the color copying machine 102 according to Embodiment Mode 4. Note that the same structural members as those in the color printer 100 and the color copying machine 102 according to Embodiment Modes 1 to 3 are denoted by the same symbols and a description thereof is omitted.

As shown in FIG. 15A, the image forming section 1 is provided with the four image forming units 1(1) to 1(4) over the upstream side to the downstream side in the conveying direction of the intermediate transfer belt 20. In the first image forming unit 1(1) to the fourth image forming unit 1(4), the different types of toner images are formed on the respective photosensitive drums 10(1) to 10(4). The toner images are successively superposed on one another at the respective primary transfer positions T1(1) to T1(4) and transferred thereto. The image forming units 1(1) to 1(4) are each provided with the photosensitive drum 10 and the primary transferring roll 15 as well as the charging roll, the exposure device, the developing device, the cleaning device, and the nonvolatile memory (not shown). Here, in the nonvolatile memory (developing unit judgement section), information on the type of toner of the toner image formed by the corresponding image forming unit 1 is stored.

Also, in the color printer 100 and the color copying machine 102 according to Embodiment Mode 4, the secondary transferring roll 24 and the belt cleaning device 27 are structured as being capable of contacting and separating from the intermediate transfer belt 20. Also, on the recording paper conveying path extending from the secondary transfer position to the fixing position, the paper conveying belt device 47 is arranged.

FIG. 16 is a functional block diagram illustrating the structure of the update control system. This control system is mainly constituted of the control unit 70. The input signal to the control unit 70 is divided as follows: (1) a toner signal from the respective nonvolatile memories 1M(1) to 1M(4); and (2) an indication signal from the user interface device 80 including the touch panel or operation buttons of the color printer 100 and the color copying machine 102. The output signal to the control unit 70 is divided as follows: (1) a drive command of the solenoids 24*s* and 27*s* with the secondary transferring roll 24 and the belt cleaning device 27 being brought into contact therewith or separating therefrom; (2) an image formation update command for updating the image processing parameter in the image processing apparatus 30; and (3) a process update command for updating the electrophotographic process parameter in each functional section of the image forming units 1(1) to 1(4).

Embodiment 19

Prior to a description of the update control operation of the color printer 100 and the color copying machine 102 according to Embodiment Mode 4, as an example thereof (Embodiment 19), a description will be given of the following case. That is, in an initial state, there are included the image forming unit 1Y corresponding to the yellow toner Y as the first image forming unit 1(1), the image forming unit 1M corresponding to the magenta toner M as the second image forming unit 1(2), the image forming unit 1C corresponding to the cyan toner C as the third image forming unit 1(3), and the image forming unit 1BK corresponding to the black toner BK as the fourth image forming unit 1(4). Thereafter, as the fourth image forming unit 1(4), the image forming unit 1BK corresponding to the black toner BK is replaced with the image forming unit 1E corresponding to the foaming toner E.

In this embodiment, the toner image (D1) formed of the yellow toner Y, the toner image (D2) formed of the magenta toner M, the toner image (D3) formed of the cyan toner C, and the toner image (D4) formed of the black toner BK are developed on the photosensitive drum 10 sequentially in the development region D, respectively, in the initial state (see FIGS. 14 and 8A1 to 8A4). These toner images are primarily transferred onto the intermediate transfer belt 20 sequentially in the primary transfer position T1(1) to T1(4). Finally, the toner image (D1) formed of the yellow toner Y, the toner image (D2) formed of the magenta toner M, the toner image (D3) formed of the cyan toner C, and the toner image (D4) formed of the black toner BK are stacked from a bottom layer to a top layer on the intermediate transfer belt 20 (see FIGS. 14 and 8B4). The stacked toner images are secondarily transferred onto the recording paper P in the secondary transfer position T2 at one time. As a result, the toner image (D4) formed of the black toner BK, the toner image (D3) formed of the cyan toner C, the toner image (D2) formed of the magenta toner M, and the toner image (D1) formed of the yellow toner Y are stacked from a bottom layer to a top layer on the recording paper P.

Next, in the case where after the image forming unit 1BK corresponding to the black toner BK is replaced with the image forming unit 1E corresponding to the foaming toner E as the fourth image forming unit 1(4), the image is formed, the update control operation shown in the flow chart of FIG. 7 is performed similarly to Embodiment Mode 1.

First, the control unit 70 makes judgement as to whether or not the image forming unit 1E is mounted to the image forming section 1 (S1 in FIG. 7). That is, the control unit 70 reads the information stored on the respective nonvolatile memories 1M(1) to 1M(4) and judges the type of the toner. When the image forming unit 1E is mounted thereto, the control unit 70 judges whether or not the image forming unit 1E is used (S2 in FIG. 7).

When the image forming unit 1E is used, the control unit 70 updates the image formation order of the image forming apparatus (S3 in FIG. 7). In this embodiment, the image formation order of the image forming apparatus is not changed. By determining an order of image formation as described above, after replacing an image forming device, the toner image (D1) formed of the yellow toner Y, the toner image (D2) formed of the magenta toner M, the toner image (D3) formed of the cyan toner C, and the toner image (D4) formed of the foamable toner E are developed on the photosensitive drum 10 sequentially in the development region D, respectively (see FIG. 14). These toner images are primarily transferred onto the intermediate transfer belt 20 sequentially in the respective primary transfer positions T1(1) to T1(4) (see FIGS. 8B1 to 8B3). Finally, the toner image (D1) formed of the yellow toner Y, the toner image (D2) formed of the magenta toner M, the toner image (D3) formed of the cyan toner C, and the toner image (D4) formed of the foamable toner E are stacked from a bottom layer to a top layer on the intermediate transfer belt 20. The stacked toner images are secondarily transferred onto the recording paper P in the secondary transfer position T2 at one time. As a result, the toner image (D4) formed of the foamable toner E, the toner image (D3) formed of the cyan toner C, the toner image (D2) formed of the magenta toner M, and the toner image (D1) formed of the yellow toner Y, are stacked from a bottom layer to a top layer on the recording paper P. That is, the toner image (D4) formed of the foamable toner E always constitutes the lowermost layer. The subsequent operation is the same as in Embodiment Modes 1 to 3.

Note that, although an order of development is automatically determined according to a type of a mounted image forming unit in Embodiment 19, the image forming apparatus can be constituted such that a user can determine the order of image formation personally via the user interface device 80.

Embodiment 20

Prior to a description of the update control operation of the color printer 100 and the color copying machine 102 according to Embodiment Mode 4, as an example thereof (Embodiment 20), a description will be given of the following case. That is, in an initial state, there are included the image forming unit 1Y corresponding to the yellow toner Y as the first image forming unit 1(1), the image forming unit 1M corresponding to the magenta toner M as the second image forming unit 1(2), the image forming unit 1C corresponding to the cyan toner C as the third image forming unit 1(3), and the image forming unit 1BK corresponding to the black toner BK as the fourth image forming unit 1(4). Thereafter, as the fourth image forming unit 1(4), the image forming unit 1BK corresponding to the black toner BK is replaced with the image forming unit 1G corresponding to the foaming toner G.

In this embodiment, similarly to Embodiment 19, finally, the toner image (D4) formed of the black toner (BK), the toner image (D3) formed of the cyan toner (C), the toner image (D2) formed of the magenta toner (M), and the toner image (D1) formed of the yellow toner (Y) are stacked from a bottom layer to a top layer on the recording paper P (see FIGS. 14 and 8C).

Next, in the case where after the image forming unit 1BK corresponding to the black toner BK is replaced with the image forming unit 1G corresponding to the gold toner G as the fourth image forming unit 1(4), the image is formed, the update control operation shown in the flow chart of FIG. 7 is performed similarly to Embodiment Mode 19.

First, the control unit 70 makes judgement as to whether or not the image forming unit 1G is mounted to the image forming section 1 (S1 in FIG. 7). That is, the control unit 70 reads the information stored on the respective nonvolatile memories 1M(1) to 1M(4) and judges the type of the toner. When the image forming unit 1G is mounted thereto, the control unit 70 judges whether or not the image forming unit 1G is used (S2 in FIG. 7).

When the image forming unit 1G is used, the control unit 70 updates the image formation order of the image forming apparatus (S3 in FIG. 7). In this embodiment, the image formation order of the image forming apparatus is changed in the following manner. That is, first, the toner image of the gold toner G is subjected to primary transferring at the primary transfer position T1(4) onto the intermediate transfer belt 20 by the image forming unit 1G. At the time when the toner image reaches the secondary transfer position T2 and the cleaning position, the control unit 70 transmits the drive command to each of the solenoids 24*s* and 27*s*. Thus, the secondary transferring roll 24 and the belt cleaning device 27 are spaced apart from the intermediate transfer-belt 20. Then, when the toner image of the gold toner G passes through the primary transfer positions T1(1) to T1(3) along with the rotation of the intermediate transfer belt 20, the toner images of the yellow toner Y, the magenta toner M, and the cyan toner C are superposed for primary transferring.

When the image formation order is determined in this way, after the replacement of the image forming unit, the toner image (D1) of the gold toner G is first subjected to primary transferring onto the intermediate transfer belt 20 (see FIG. 8B1). Next, the toner image (D1) makes approximately one rotation together with the intermediate transfer belt 20 and subsequently, the toner image (D2) of yellow toner Y, the toner image (D3) of magenta toner M, and the toner image (D4) of cyan toner C are subjected to primary transferring onto the intermediate transfer belt 20 in order (see FIGS. 8B2 to 8B4). Finally, on the intermediate transfer belt 20, the toner image (D1) of gold toner G, the toner image (D2) of yellow toner Y, the toner image (D3) of magenta toner M, and the toner image (D4) of cyan toner C are laminated from the lower layer to the upper layer thereof. The laminated toner images are subjected to secondary transferring onto the recording paper P at the secondary transfer position T2 at a time. As a result, on the recording paper P, the toner image (D4) of cyan toner C, the toner image (D3) of magenta toner M, the toner image (D2) of yellow toner Y, and the toner image (D1) of gold toner G are laminated from the lower layer to the upper layer thereof. That is, the toner image (D1) of gold toner G always constitutes the uppermost layer. The subsequent operation is the same as in Embodiment Modes 1 to 3.

Embodiment Mode 5

In the color printer 100 and the color copying machine 102 according to Embodiment Mode 5, the image forming units (first image forming units) 1Y to 1BK corresponding to the toners (first developers including not foaming agent but colorant of nonmetallic color) of the respective colors of yellow (Y), cyan (C), magenta (M), and black (BK) and in addition, the image forming unit (second image forming unit) 1E corresponding to the foaming toner E (second developer including not the colorant but the foaming agent), or the image forming unit (second image forming unit) 1G corresponding to the gold toner G (second developer including not the foaming agent but the colorant of metallic color) can be mounted thereto. Note that the same structural members as those in the color printer 100 and the color copying machine 102 according to Embodiment Mode 4 are denoted by the same symbols and a description thereof is omitted.

Embodiment 21

Prior to a description of the update control operation of the color printer 100 and the color copying machine 102 according to Embodiment Mode 5, as an example thereof (Embodiment 21), a description will be given of the following case. That is, in an initial state, there are included the image forming unit 1Y corresponding to the yellow toner Y as the first image forming unit 1(1), the image forming unit 1M corresponding to the magenta toner M as the second image forming unit 1(2), the image forming unit 1C corresponding to the cyan toner C as the third image forming unit 1(3), and the image forming unit 1BK corresponding to the black toner BK as the fourth image forming unit 1(4). Thereafter, the image forming unit 1E corresponding to the foaming toner E is added as the fifth image forming unit 1(5).

As shown in FIG. 15B, in the case where after the image forming unit 1E corresponding to the foaming toner E is added as the fifth image forming unit 1(5), the image is formed, the update control operation shown in the flow chart of FIG. 7 is performed similarly to Embodiment Mode 1.

When the image forming unit 1E is used, the control unit 70 updates the image formation order of the image forming apparatus (S3 in FIG. 7). In this embodiment, the image formation order of the image forming apparatus is not changed. By determining an order of image formation as described above, after replacing the image forming unit, the toner image (D1) formed of the yellow toner Y, the toner image (D2) formed of the magenta toner M, the toner image (D3) formed of the cyan toner C, the toner image (D4) formed of the black toner BK, and the toner image (D5) formed of the foamable toner E are developed on the photosensitive drum 10 sequentially in the development region D, respectively (see FIG. 14). These toner images are primarily transferred onto the intermediate transfer belt 20 sequentially in the respective primary transfer positions T1(1) to T1(5) (see FIGS. 13B1 to 13B5). Finally, the toner image (D1) formed of the yellow toner Y, the toner image (D2) formed of the magenta toner M, the toner image (D3) formed of the cyan toner C, the toner image (D4) formed of the black toner BK, and the toner image (D5) formed of the foamable toner E are stacked from a bottom layer to a to player on the intermediate transfer belt 20. The stacked toner images are secondarily transferred onto the recording paper P in the secondary transfer position T2 at one time. As a result, the toner image (D5) formed of the foamable toner E, the toner image (D4) formed of the black toner BK, the toner image (D3) formed of the cyan toner C, the toner image (D2) formed of the magenta toner M, and the toner image (D1) formed of the yellow toner Y, are stacked from a bottom layer to a top layer on the recording paper P. That is, the toner image (D5) formed of the foamable toner E always constitutes the lowermost layer. The subsequent operation is the same as in Embodiment Modes 1 to 3.

Embodiment 22

Prior to a description of the update control operation of the color printer 100 and the color copying machine 102 according to Embodiment Mode 4, as an example thereof (Embodiment 22), a case in which the image forming unit 1G corresponding to the gold toner G is added is explained.

As shown in FIG. 15B, in the case where after the image forming unit 1G corresponding to the gold toner G is added as the fifth image forming unit 1(5), the image is formed, the update control operation shown in the flow chart of FIG. 7 is performed similarly to Embodiment 21.

When the image forming unit 1G is used, the control unit 70 updates the image formation order of the image forming apparatus (S3 in FIG. 7). In this embodiment, the image formation order of the image forming apparatus is changed in the following manner. That is, first, the toner image of the gold toner G is subjected to primary transferring at the primary transfer position T1(4) onto the intermediate transfer belt 20 by the image forming unit 1G. At the time when the toner image reaches the secondary transfer position T2 and the cleaning position, the control unit 70 transmits the drive command to each of the solenoids 24*s* and 27*s*. Thus, the secondary transferring roll 24 and the belt cleaning device 27 are spaced apart from the intermediate transfer belt 20. Then, when the toner image of the gold toner G passes through the primary transfer positions T1(1) to T1(4) along with the rotation of the intermediate transfer belt 20, the toner images of the yellow toner Y, the magenta toner M, the cyan toner C, and the black toner BK are superposed for primary transferring.

Figure 13:
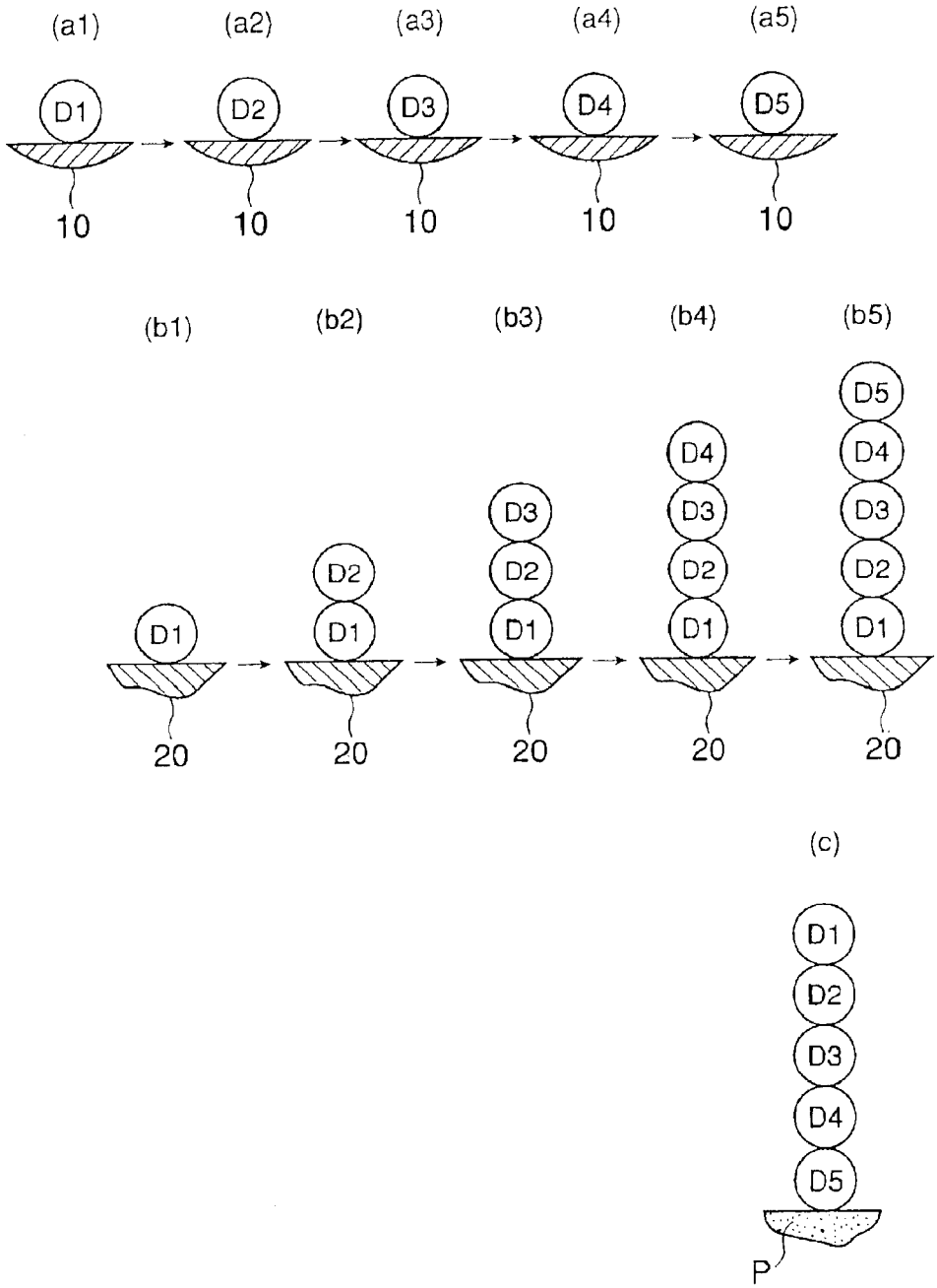

When the image formation order is determined in this way, after the replacement of the image forming unit, the toner image (D1) of the gold toner G is first subjected to primary transferring onto the intermediate transfer belt 20 (see FIG. 13B1). Next, the toner image (D1) makes approximately one rotation together with the intermediate transfer belt 20 and subsequently, the toner image (D2) of yellow toner Y, the toner image (D3) of magenta toner M, the toner image (D4) of cyan toner C, and the toner image (D5) of black toner BK are subjected to primary transferring onto the intermediate transfer belt 20 in order (see FIGS. 13B2 to 13B5). Finally, on the intermediate transfer belt 20, the toner image (D1) of gold toner G, the toner image (D2) of yellow toner Y, the toner image (D3) of magenta toner M, the toner image (D4) of cyan toner C, and the toner image (D5) of black toner BK are laminated from the lower layer to the upper layer thereof. The laminated toner images are subjected to secondary transferring onto the recording paper P at the secondary transfer position T2 at a time. As a result, on the recording paper P, the toner image (D5) of black toner BK, the toner image (D4) of cyan toner C, the toner image (D3) of magenta toner M, the toner image (D2) of yellow toner Y, and the toner image (D1) of gold toner G are laminated from the lower layer to the upper layer thereof (see FIG. 13C). That is, the toner image (D1) of gold toner G always constitutes the uppermost layer. The subsequent operation is the same as in Embodiment Modes 1 to 4.

Foaming Toner

The foaming toner E used in Embodiments 1 to 5 will be hereinafter described in detail. The foamable toner E is a toner for image formation containing at least a binder resin and a foaming agent, and a toner in which a foaming agent is not substantially exposed to the surface of the toner is used as the foamable toner E.

Any foaming agent can be used without particular limitation as long as it expands in volume with heat. It may be solid or liquid under the normal temperature. In addition, a material of the foaming agent is not limited to a material including a single substance but may be a material including plural substances or a functional material such as micro-capsule particles. A preferable range of a foaming temperature of the foaming agent differs depending on what type of apparatus is used to form a three-dimensional image. In the case where a three-dimensional image is formed using the ordinary printer or copying machine as shown in FIG. 1 or 2, the foaming temperature is preferably equal to or lower than a heating and fixing temperature.

As the foaming agent, for example, a foaming agent containing a substance generating gas due to thermal decomposition as a main material can be used. More specifically, examples of the foaming agent include bicarbonate such as sodium bicarbonate generating carbon dioxide, a mixture of $NaNo_2$ and $NH_4Cl$ generating nitrogen gas, azo compounds such as azobisisobutyronitrile and diazoaminobenzene, and peroxide generating oxide and the like.

Other forms of the foaming agent include a foaming agent of micro-capsule particles encapsulating a low boiling point substance that vaporizes at a low temperature (which may be in a liquid state or a solid state under the normal temperature) (hereinafter referred to as "micro-capsule type foaming agent" in some cases). The micro-capsule type foaming agent is preferable because it is highly foamable. In the case where the toner for image formation of this embodiment mode is used in the ordinary printer, copying machine, or the like, the low boiling point substance contained in the micro-capsule is required to at least vaporize at a temperature lower than the heating and fixing temperature. More specifically, it is a substance that vaporizes at 100° C. or less, preferably 50° C. or less, and more preferably 25° C. or less. However, since thermal responsiveness of the micro-capsule type foaming agent depends not only on a boiling point of the low boiling point substance, which serves as a core material, but also on a softening point of a wall material, a preferable boiling point range of the low boiling point material is not limited to the aforementioned range. Examples of the low boiling point substance include neopentane, neohexane, isopentane, isobutylene, and isobutane. Among them, isobutane is preferable which is stable with respect to the wall material of the micro-capsule and has a high thermal expansion coefficient.

As the wall material of the micro-capsule, a material is preferable which has solvent resistance against various solvents used in a manufacturing process of a toner and has non-permeability against gas when the low boiling point substance encapsulated in the micro-capsule vaporizes. In addition, in the case where the toner for image formation of this embodiment mode is used for the ordinary printer, copying machine, or the like, the wall material is required to soften and expand at a temperature lower than the heating and fixing temperature. As the wall material of the micro-capsule, a wall material that has been used conventionally can be used extensively. For example, a homopolymer such as polyvinyl chloride, polyvinyl acetate, polystyrene, polyacrylonitrile, polybutadiene, and polyacrylic acid ester, and copolymers of these are preferably used. Among them, a copolymer of vinylidene chloride and acryronitrile is preferable in that it has a high adhesive property with a binder resin and has a high solvent resistance against solvents.

A preferable range of a content of the foaming agent in the toner of this embodiment mode varies depending upon a type of the foaming agent. Usually, it is 5 to 50 wt %, and preferably 10 to 40 wt %. When the content of the foaming agent is 5 wt % or less, thermal expansion of the toner may become insufficient practically. On the other hand, when the content of the foaming agent exceeds 50 wt %, a percentage of the binder resin in the toner may become insufficient relatively to cause a problem such as failure to obtain a sufficient fixing property.

The binder resin of the toner for three-dimensional image formation of this embodiment is not specifically limited, and any resin that is generally used as a resin for toner can be used. More specifically, a polyester resin, a styrene resin, an acrylic resin, a styrene-acrylic resin, a silicone resin, an epoxy resin, a diene resin, a phenol resin, an ethylene-vinyl acetate resin, and the like can be used. Among them, the polyester resin is more preferable.

Two or more kinds of the polyester resin may be combined and other resins may be further combined with the binder resin of this embodiment mode. As other resins, there are a styrene resin, an acrylic resin, a styrene-acrylic resin, a silicone resin, an epoxy resin, a diene resin, a phenol resin, a terpene resin, a coumarin resin, an amide resin, an amide-imide resin, a butyral resin, a urethane resin, an ethylene-vinyl acetate resin, a polypropylene resin, a polyethylene resin, and a natural wax resin such as Carnauba wax. In this embodiment mode, it is preferable to use the polyester resin as a main component and add the other resins in an amount of 0 to 30 wt %. In addition, in the case where a foaming agent is dispersed in a monomer of the binder resin to produce a toner by suspending and polymerizing these, a monomer, which can be suspended and polymerized, in the binder resin can be used.

When a toner particle of the foamable toner E is sliced and the slice is observed with a microscope, it is found that the toner consists at least of the binder resin and a foaming agent particle, and the foaming agent particle is contained on the core portion side of the toner without losing a foaming property. Since the toner particle of the foamable toner E has a structure in which the foaming agent is not substantially exposed to its surface, the toner has a high thermal expansion property and, at the same time, favorably maintains an adhesive property and a charging stability with respect to a recording medium.

Note that "not substantially exposed to its surface" in this context indicates that, for example, as a result of observing electron micrographs of fifty toner particles, it is found that there are 80% or more toners in which the foaming agent is not exposed to the surface thereof at all. In addition, it is preferable that the foaming agent is dispersed as particles in the toner uniformly because the adhesive property and the charging stability of the toner with respect to the recording medium can be improved more.

A colorant is not contained in the foamable toner E of Embodiment Mode 1. However, a colorant may be contained to color and visualize the toner. As a colorant to be dispersed, a publicly known organic or inorganic pigment, dye, or oil-soluble dye can be used. In general, a percentage of approximately 1 to 100 parts by weight is appropriate for these colorants with respect to 100 parts by weight of toner, although it depends on a particle diameter of toner or an amount of development.

In addition, a magnetic substance may be contained in the foamable toner E in order to give magnetization to the toner. As a type of the magnetic substance, a publicly known one can be used appropriately. Moreover, a release agent may be contained in the foamable toner E if so desired. This is preferable because an offset phenomenon or the like at the time when the foamable toner E is brought into contact with a recording paper and fixed thereon can be prevented by containing the release agent in the toner. Note that a charging control agent may be added in the foamable toner E if so desired. Moreover, a publicly known externally added agent may be contained in the foamable toner E in order to control its flowability and developing property.

As a method of producing the foamable toner E, for example, the foamable toner foamable toner E is produced by a process including a step of suspending and dispersing an oil phase, in which at least a binder resin and a foaming agent are dissolved and/or dispersed in a solvent, in a water phase to produce particles including the oil phase and a step of removing the solvent from the particles. In addition, the foamable toner E may be produced by a process including a step of suspending and polymerizing a monomer for binder resin, in which at least a foaming agent is dissolved or dispersed, in a water phase. In the foamable toner E, a binder polymer was contained as a binder resin by 75 wt % and Expancel 461 by 25 wt %. A volume average particle diameter of this foamable toner E was approximately 30 $\mu$m.

In using the foamable toner E, a development system may be any of the two-component development system, the nonmagnetic one-component development system, and the magnetic one-component development system. In this embodiment mode, the two-component development system is adopted to form an image. As a toner composition, a wax for realizing oil-less heat fixing may be contained or may not be contained both in a foamable toner and a non-foaming full-color toner. In this embodiment mode, toners in which the wax is not contained are adopted for both of a foaming toner and a non-foaming color toner, and an image is formed by a soft roll fixing apparatus equipped with an oil system.

What is claimed is:

1. An image forming apparatus comprising:

an image bearing member;

a first developing unit for forming an image including one kind or plural kinds of first developer on the image bearing member;

a transfer section for transferring the image formed on the image bearing member onto a recording medium, the image forming apparatus being capable of mounting thereto a second developing unit for forming an image including one kind or plural kinds of second developer on the image bearing member; and a control unit for controlling the image forming apparatus such that, in a case of using the second developing unit mounted thereto, an image developed using the second developer is formed into a specific-level layer within a stack of images on the recording medium.

2. An image forming apparatus according to claim 1, wherein the second developing unit is mountable by replacing an entirety or a part of the first developing unit.

3. An image forming apparatus according to claim 1, wherein the second developing unit is mountable by being added to the first developing unit.

4. An image forming apparatus comprising:

an image bearing member;

a first developing unit for forming an image including one kind or plural kinds of first developer on the image bearing member;

a transfer section for transferring the image formed on the image bearing member onto a recording medium, the image forming apparatus being capable of mounting thereto a second developing unit for forming an image including one kind or plural kinds of second developer on the image bearing member;

a developing unit judging section for judging a kind of a developing unit included in the image forming apparatus; and a control unit for controlling the image forming apparatus such that, in a case of using the second developing unit mounted thereto, an image developed using the second developer is formed into a specific-level layer within a stack of images on the recording medium.

5. An image forming apparatus according to claim 4, wherein the specific-level layer is automatically determined in accordance with the kind of the second developing unit to be used.

6. An image forming apparatus according to claim 5, wherein the first developer contains no foaming agent and the second developer contains a foaming agent.

7. An image forming apparatus according to claim 6, wherein the specific-level layer is a lowermost layer in the stack of the images on the recording medium.

8. An image forming apparatus according to claim 5, wherein the first developer contains a colorant of a nonmetallic color and the second developer contains a colorant of a metallic color.

9. An image forming apparatus according to claim 8, wherein the specific-level layer is an uppermost layer in the stack of the images on the recording medium.

10. An image forming apparatus according to claim 4, wherein a user interface section to which an instruction from a user is inputted is provided, and the specific-level layer is determined based on an instruction from the user interface section.

11. An image forming apparatus according to claim 4, wherein the control unit controls stacking of the images on the recording medium by controlling an order that each developing unit forms an image on the image bearing member.

12. An image forming apparatus according to claim 4, wherein the control unit controls stacking of the images by controlling an order that the transfer section transfers the images.

13. An image forming apparatus according to claim 4, wherein the control unit controls the image forming apparatus such that, in a case of using the second developing unit mounted thereto, an image developed using the second developer is formed to be laminated on the recording medium based on an electrophotographic parameter which differs from the electrophotographic parameter used in a case where an image developed using the first developer is formed to be laminated on the recording medium.

14. An image forming apparatus according to claim 13, wherein the electrophotographic parameter is automatically determined by the kind of the second developing unit to be used.

15. An image forming apparatus according to claim 4, wherein the developing unit has a special shape in accordance with its developer, and the developing unit judging section judges the kind of the mounted developing unit based on the special shape.

16. An image forming apparatus according to claim 4, wherein the developing unit includes a nonvolatile memory for storing developer information that indicates a developer of the developing unit in the nonvolatile memory, and includes the developing unit judging section for judging the kind of the mounted developing unit based on the developer information which is read.

17. An image forming apparatus according to claim 4, wherein the second developing unit is mountable by replacing an entirety or a part of the first developing unit.

18. An image forming apparatus according to claim 4, wherein the second developing unit is mountable by being added to the first developing unit.

19. An image forming apparatus comprising:

an image bearing member;

a first developing unit for forming an image including one kind or plural kinds of first developer on the image bearing member;

a transfer section for transferring the image formed on the image bearing member onto a recording medium, the image forming apparatus being capable of mounting thereto a second developing unit for forming an image including one kind or plural kinds of second developer on the image bearing member;

a user interface section to which an instruction from a user is inputted; and a control unit for controlling the image forming apparatus such that, in a case of using the second developing unit mounted thereto, an image developed using the second developer is formed into a specific-level layer within a stack of images on the recording medium, the specific-level layer being determined based on the instruction from the user interface section.

20. An image forming apparatus according to claim 19, wherein the second developing unit is mountable by replacing an entirety or a part of the first developing unit.

21. An image forming apparatus according to claim 19, wherein the second developing unit is mountable by being added to the first developing unit.

* * * * *